US007185927B2

(12) United States Patent
Talukdar et al.

(10) Patent No.: US 7,185,927 B2
(45) Date of Patent: Mar. 6, 2007

(54) GLOVEBOX LATCH

(75) Inventors: Robin Talukdar, Wilmington, DE (US); Fabrice Vitry, Worchester (GB)

(73) Assignee: Southco, Inc., Concordville, PA (US)

( * ) Notice: Subject to any disclaimer, the term of this patent is extended or adjusted under 35 U.S.C. 154(b) by 246 days.

(21) Appl. No.: 10/409,480

(22) Filed: Apr. 7, 2003

(65) Prior Publication Data

US 2003/0193199 A1 Oct. 16, 2003

Related U.S. Application Data

(60) Provisional application No. 60/436,317, filed on Dec. 23, 2002, provisional application No. 60/370,347, filed on Apr. 7, 2002.

(51) Int. Cl.
*E05C 1/12* (2006.01)
*E05C 19/10* (2006.01)

(52) U.S. Cl. ..... 292/172; 292/124; 292/169; 292/DIG. 56; 292/DIG. 61

(58) Field of Classification Search ..... 292/124, 292/98, 159, 160, 165, 169, 169.11, 172, 292/140, 142, 192, 279, 280, DIG. 7, DIG. 20, 292/DIG. 21, DIG. 47, 95, DIG. 61, DIG. 56, 292/DIG. 22, 112, 199, 1, 9, 15
See application file for complete search history.

(56) References Cited

U.S. PATENT DOCUMENTS 745,042 A * 11/1903 Daves ..... 292/185
1,464,458 A * 8/1923 Whartenby ..... 292/39
1,711,213 A * 4/1929 Smith ..... 292/198
1,738,648 A * 12/1929 Hall ..... 292/241
2,117,339 A * 5/1938 Claud-Mantle ..... 292/123
2,146,379 A * 2/1939 Rediger ..... 292/198
2,424,450 A * 7/1947 Ghia ..... 292/244
2,719,745 A * 10/1955 Kent et al. ..... 292/112
2,934,370 A * 4/1960 Love et al. ..... 292/142
3,767,244 A * 10/1973 Plaw ..... 292/227
3,918,754 A 11/1975 Isbister
4,476,700 A * 10/1984 King ..... 70/99
4,616,864 A * 10/1986 Douglas ..... 292/336.3
4,725,085 A * 2/1988 Hu et al. ..... 292/172
4,807,914 A * 2/1989 Fleming et al. ..... 292/48
4,838,056 A 6/1989 Weinerman et al.

(Continued)

FOREIGN PATENT DOCUMENTS

DE 3732138 4/1988

(Continued)

*Primary Examiner*—Brian E. Glessner
*Assistant Examiner*—Carlos Lugo
(74) *Attorney, Agent, or Firm*—Paul & Paul

(57) ABSTRACT

A latch assembly is re-configurable for plural orientations. A slide lock plate engages a claw-typed pawl. A rotating activation mechanism links an operator handle to the slide plate. The handle causes the activation mechanism to rotate, thereby retracting the sliding lock plate form the pawl. A cam follower, activated by a pocket cam, is rotated with handle operation. A first pinion gear on the sliding lock plate and a friction clutch dampen movement. A rotating paddle/blade cam, substituted for the paddle/blade, has a projecting arm. The second pinion gear engages teeth on the edge of the slide lock plate. A dog leg-shaped projection, added to the handle end of the slide plate, accommodates second teeth facing opposite the first teeth.

21 Claims, 25 Drawing Sheets

U.S. PATENT DOCUMENTS 4,850,208 A 7/1989 Weinerman et al.
4,911,487 A 3/1990 Rachocki
4,934,800 A * 6/1990 Choi ..... 292/172
4,962,652 A * 10/1990 Schneider ..... 70/89
4,969,916 A 11/1990 Weinerman et al.
4,973,091 A * 11/1990 Paulson et al. ..... 292/51
4,979,384 A 12/1990 Malesko et al.
4,989,907 A 2/1991 Edmonds et al.
5,020,838 A 6/1991 Fukumoto
5,046,340 A 9/1991 Weinerman et al.
5,060,991 A * 10/1991 Davidian et al. ..... 292/172
5,098,141 A 3/1992 Bull
5,127,686 A 7/1992 Gleason et al.
5,172,944 A * 12/1992 Munich et al. ..... 292/39
5,234,238 A 8/1993 Takimoto
5,280,881 A * 1/1994 Karmin ..... 70/279.1
5,299,844 A 4/1994 Gleason
5,301,989 A * 4/1994 Dallmann et al. ..... 292/142
5,340,174 A 8/1994 Bender et al.
5,413,391 A 5/1995 Clavin et al.
5,484,178 A * 1/1996 Sandhu et al. ..... 292/173
5,642,636 A * 7/1997 Mitsui ..... 70/237
5,927,769 A * 7/1999 Pullen ..... 292/169.13
5,927,772 A * 7/1999 Antonucci et al. ..... 292/336.3
5,988,709 A * 11/1999 Lee et al. ..... 292/199
6,023,952 A * 2/2000 Mantarakis et al. ..... 70/99
6,048,001 A * 4/2000 Miller et al. ..... 292/198
6,048,006 A * 4/2000 Antonucci et al. ..... 292/336.3
6,095,573 A * 8/2000 Rozema ..... 292/51
6,116,067 A 9/2000 Myers et al.
6,120,069 A * 9/2000 Taranto ..... 292/35
6,164,711 A * 12/2000 Neal et al. ..... 296/37.12
6,256,194 B1 * 7/2001 Choi et al. ..... 361/683
6,264,257 B1 * 7/2001 Meinke ..... 292/336.3
6,290,270 B1 * 9/2001 Spiessl ..... 292/226
6,328,357 B1 * 12/2001 Overbey et al. ..... 292/336.3
6,460,904 B1 * 10/2002 Stapf ..... 292/336.3

FOREIGN PATENT DOCUMENTS

GB 2252351 A * 8/1992
GB 2257745 A * 1/1993
GB 2277958 A * 11/1994

* cited by examiner

131

131
143
143

143
143
153
173
149
139
134
127
129

139

139

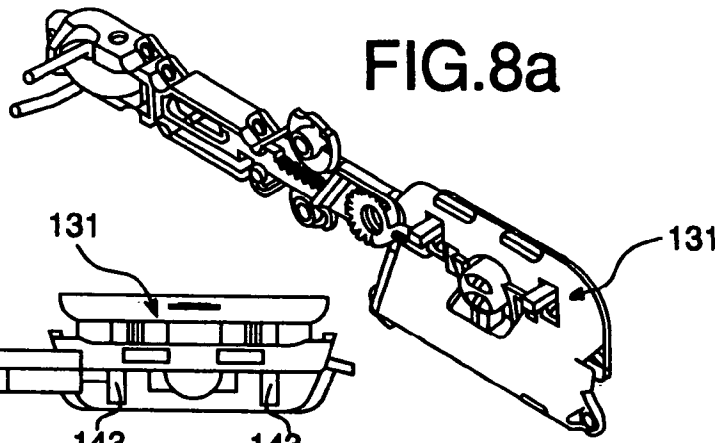
FIG.8a
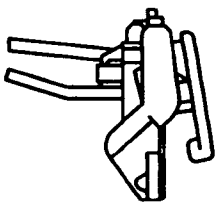
FIG.8f
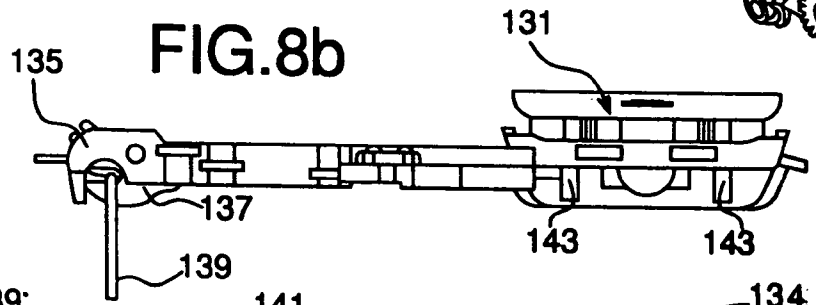
FIG.8b
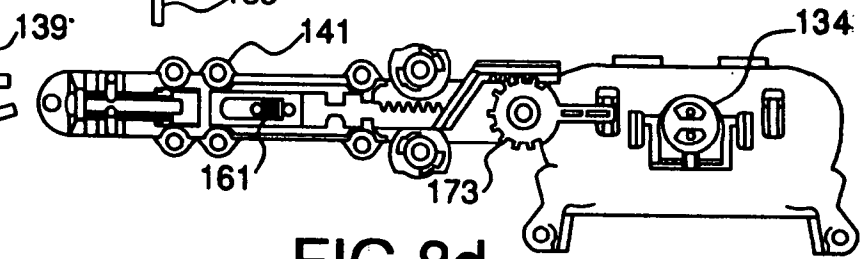
FIG.8d
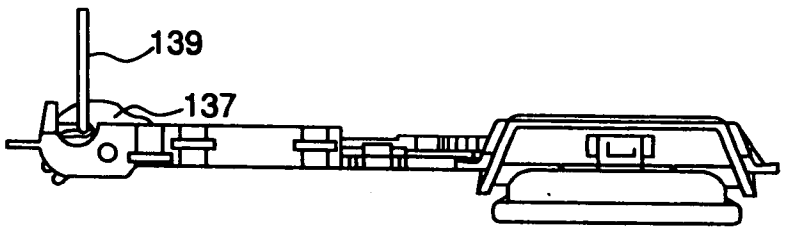
FIG.8c
FIG.8e

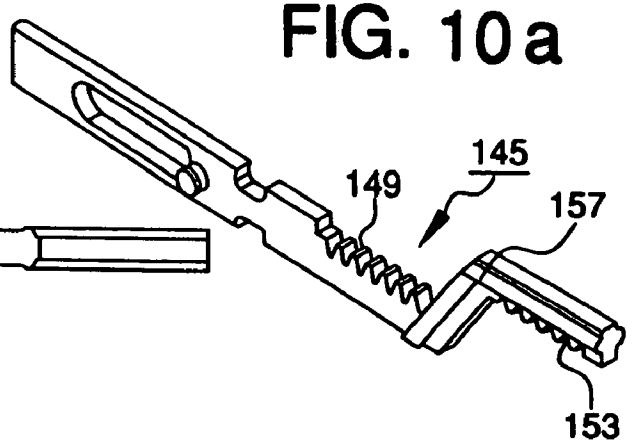
FIG. 10a
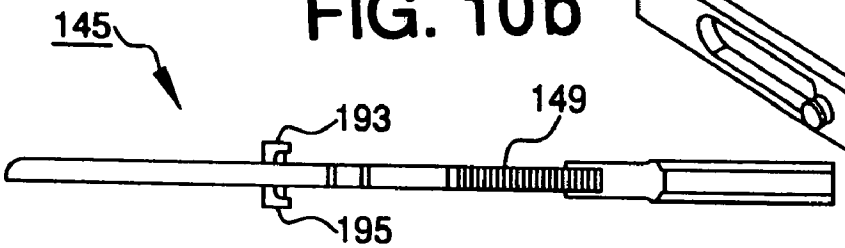
FIG. 10b
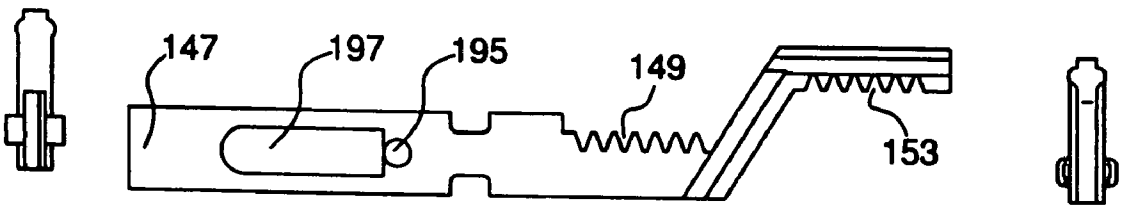
FIG. 10e
FIG. 10f
FIG. 10d
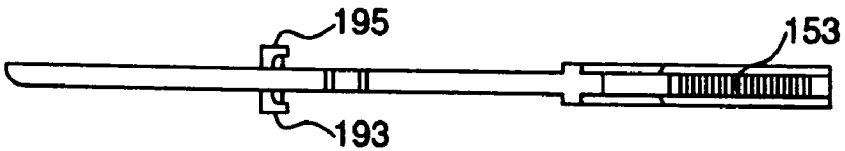
FIG. 10c

GLOVEBOX LATCH

RELATED APPLICATIONS

The present invention relates to latches and latch assemblies. Specifically, the present invention relates to U.S. Provisional Patent Application 60/370,347, filed Apr. 7, 2002, for a Glovebox Latch and to U.S. Provisional Patent Application 60/436,317, filed Dec. 23, 2002, for a Rotating Pocket Cam Govebox Latch.

BACKGROUND OF THE INVENTION

Brief Description of the Related Art

A latch and latch assemblies are relied upon in many applications for securing panels and doors to cabinets and enclosures. For example, closets and compartments and the like may have doors and pivotal panels, which may be secured with a releasable latch.

One use for such latches is in the automotive field, where it is desirable to access automotive compartments, such as for example, a trunk compartment or a passenger compartment in a vehicle, as well as a glovebox. In this regard, various latches for panel closures have been employed mounted to a moveable panel, such as a swinging door on an automotive glovebox. Typically such glovebox doors swing open downwardly, with the weight of the door exerting a force on the latch prior to opening. Safety standards for modern automobiles have caused manufacturers to position gloveboxes and glovebox doors lower than previously, and often at knee level, almost under the dashboard. This has caused glovebox doors to support the weight of the contents of the glovebox, whether latched or open.

An example of a latch is shown in U.S. Pat. No. 4,838,056, issued to L. S. Weinerman, et al. Weinerman discloses a latch and lock assembly having expansible latch elements. In another publication, Weinerman, et al., U.S. Pat. No. 4,850,208, describe a latch and lock assembly with spring-biased pivotal pivot bolts. A rotary paddle latch is shown by M. J. Rachocki, U.S. Pat. No. 4,911,487; while a paddle handle latch is shown by M. Edmonds, et al. in U.S. Pat. No. 4,989,907. K. A. Bull, in U.S. Pat. No. 5,098,141, shows a quick release glovebox latch mechanism. S. J. Gleason, et al. describe a door closure assembly in U.S. Pat. No. 5,127,686. Ratchet-type latch assemblies have been shown by K. Takimoto, in U.S. Pat. No. 5,234,238.

These latches, however, are generally designed for a specific application, i.e., a specific structural design configuration. For automotive glovebox applications, these latches, typically, are positioned at the center of a glovebox, juxtaposed the keeper hook. Moreover, each latch has been designed specifically for upper bin operation or for lower bin operation, with no interchangeability between the respective operations.

What is desired is a latch assembly, which has universal application, and which will enable an automotive glovebox latch release handle or paddle to be positioned at the side of the glovebox, when the glovebox door panel keeper is centered in its customary position.

What is also desired is that this off-set latch assembly be re-configurable to provide its capability of operation, regardless of paddle and keeper positioning in upper bin operation or in lower bin operation.

What is further desired is that this off-set re-configurable latch assembly provide a structure which has an ease of operation for the latch release, when the latch has increased pressures against resulting from the weight of objects stored in the glovebox and laying against the glovebox door panel.

What is even further desired is a latch assembly with a linking or activation mechanism with improved mechanical strength.

The objects of this invention are to provide these features in one structure, in which the component elements remain the same, but the assembly of such is re-configurable for the specific application.

SUMMARY OF THE INVENTION

The objects of the present invention are realized in a latch assembly, which can be used as an automotive glovebox latch. This latch assembly has snap-together construction that also facilitates the mechanical reconfiguration of its mechanical parts. The latch assembly provides the capability of multiple and/or universal installation design applications, in order to meet the requirements for various glovebox latch assemblies. The latch assembly is elongate which facilitates a horizontal mounting and an off-set pawl and keeper location from the paddle or operating handle. The latch assembly can be used in both right-hand drive and left-hand drive vehicles, as well as in upper bin location and lower bin location keeper and latch operation. The present latch assembly is capable of being mounted to operate a keeper release, when the glovebox latch handle or paddle is located on either the left side of the glovebox or on the right side of the glovebox.

Included as part of this latch is an elongate housing which carries a plurality of bosses for mounting the housing, and the assembly carried thereon. The housing is mounted to the, inside face of the glovebox door panel or bin.

Mounted for operation at a first end of the housing is a standard claw-shaped pawl, facing outwardly from the end of the housing. This pawl pivots to engage a keeper, whereof the operation of the pawl is spring biased to the open position. The pawl includes a rearward projecting finger extending towards the body of the housing.

The rearward-projecting finger of the pawl is engaged by a blade-shaped end of a slideable lock plate. This lock plate is elongate and slides longitudinally within the housing, and more specifically within a housing defined slot portion. The sliding lock plate locks the pawl in its closed position when its blade end engages the rearward-projecting finger, i.e., the blade intercepts the pawl finger's rotational path, and thereby prohibits the pawl from rotating open. The sliding lock plate is spring biased to the locked or pawl engagement position.

The sliding lock plate may include a movement dampening device. Usually this movement dampening device includes a toothed portion which mates with a toothed portion along the body of the sliding lock plate.

The sliding lock plate is engaged by (linked to) the handle (paddle) through the operation of an activation mechanism which activation mechanism is caused to rotate under the force of the handle/paddle rotation, whereby by a projecting shoulder or projecting flange on the handle/paddle engages and rotates a portion of the activation mechanism. The rotation of the activation mechanism, which is connected to the sliding lock plate causes the sliding lock plate to retract from engagement with the pawl and thereby the pawl rotates open under its biasing spring force.

The activation mechanism is either symmetrically shaped or can be flipped-over. Both of these features permit left hand and right hand operation. When a flip-over structure is used, the sliding lock plate includes a dog-leg shaped arm extension at the handle end and carries a first and second edge tracks of teeth, one for each respective handed operation. Furthermore, the symmetrical activation mechanism can take more than one shape, one or more of which would require the addition of a track of teeth on a face of the sliding lock plate at the handle end thereof.

When the symetrical structure is present, the slidable lock plate is linked to the handle/paddle by either of two structures, depending upon whether the latch assembly is configured for upper bin operation or lower bin operation. Because of the symmetry, the latch assembly needs to merely be switched end for end between left and right handed installations.

When configured for lower bin mounting, the end of the lock plate carries a transversely projecting pivot upon which a pocket cam rotates. An elongated oval camming surface forms a pocket on the interior of the camming member. A finger projects outwardly from the periphery of the pocket cam. The pocket cam is symmetrically shaped about the longitudinal axis of the housing, with the cam's finger extending along the longitudinal axis of the housing, away from the pawl and towards the handle, when in the latch is in the rest or inoperative position.

A projecting shoulder on the handle engages the cam's finger when the handle is operated. This causes the cam to rotate on its pivot. The elongate, oval-like enclosed camming surface, carried within the cam (in a pocket thereof), engages a follower pin at the end of the slidable lock plate. When the cam is caused to rotate by the operation of the handle against the finger, the follower pin is moved towards tha handle and the lock plate slides out of engagement with the pawl.

By configuring the cam and its pocket symmetrically about the longitudinal axis of the latch, the latch can be mounted for both right hand and left hand operation. The cam operates the latch identically, whether it is rotated clockwise or counter clockwise.

Configured for upper bin mounting, the pocket cam is replaced with a paddle cam that carries one or more teeth. These teeth engage teeth at the adjacent end of the lock plate to move the plate out of engagement with the pawl. The paddle cam includes T-shaped projections, extending laterally (transversely) to either side of the longitudinal axis of the housing. When the handle is rotated, a projection on the handle engages one of the paddle cam projections causing the paddle cam to rotate. This rotation causes a movement of the slide plate because the respective teeth of the slide plate and the paddle cam are engaged. The teeth on the slide plate operated similar to a rack with the teeth on the paddle cam acting similar to a pinion. Because the paddle cam is symmetrically shaped about the longitudinal axis of the housing, this structure can again be interchangeably mounted for both left-handed and right-handed operation.

In symmetrical structure configuration, upper bin or lower bin, mounting, the cam need only rotate about 15 to 30 degrees to cause the locking plate to disengage from the pawl.

When flip-over structure is present, the lock plate also includes intermediate along its length, a pair of elongate longitudinal slots which act to keep the lock plate within the housing while permitting it to slide back and forth, from left to right within the housing, when the housing is mounted horizontally. A first length of gear teeth are carried along at least one edge of the lock plate for a selected distance, to operate as a gear track (or rack). Immediately outboard from this gear track, at the end of the lock plate opposite the blade, is an off-set arm which has a second length of gear teeth on its inwardly facing edge, the edge facing the centerline of the lock plate. This off-set arm is a dog-leg shaped extension arm extending beyond the main body of the lock plate. The first and second gear tracks (racks) each extend in respective separate planes, which are each parallel to the longitudinal axis of the lock plate.

A first pair of pivot posts or bushing journals are positioned on the housing outboard of the operational path of the slidable lock plate. This pair is positioned in the location of the first gear track, one each on either side of the lock plate. A third pivot post or bushing journal is positioned at the end of the housing opposite the pawl hook in a location adjacent the second gear track.

A pinion gear is selectably mountable onto the housing, on any of the three pivot posts, to co-act with and operate against either the first gear track or the second gear track. In position, the pinion gear teeth engage the respective gear track teeth. A rotation of the pinion gear moves the lock plate along the housing length.

The housing carries an outwardly extending guide post for every elongate slot in the lock plate. These guide posts keep the lock plate from binding in the housing, by securing it against lateral movement.

For upper bin paddle operation this pinion gear is mounted on a pivot post to engage the first gear track. For lower bin paddle operation, this pinion gear is mounted to operate against the second gear track carried on the dog-leg shaped arm extension of the lock plate.

The pinion gear has teeth along an arc section of its outer circumference, extending about 120 degrees. Positioned approximately diagonally opposite the first end tooth on the pinion gear is a radially outwardly extending cantilever arm. This cantilever arm is engaged by the bin or panel paddle (opening handle). The operation of the paddle causes the pinion gear to rotate and the lock plate to retract, thereby, causing the blade member to release the pawl, which pawl then rotates to the open position responsive to its biasing spring. When the pawl rotates to the open or disengaged position under the force of its biasing spring, the bin of the glovebox, or the door panel as the case may be, falls open from gravitational forces.

The pinion gear's cantilever arm is mounted to always be askew with the face of the paddle that it contacts. Therefore, as the contacting face of the paddle moves towards the cantilever arm, the end of the arm rides along the contacting face resulting in a rotation of the pinion gear.

BRIEF DESCRIPTION OF THE DRAWINGS

The features, advantages and operation of the present invention will become readily apparent and further understood from a reading of the following detailed description with the accompanying drawings, in which like numerals refer to like elements, and in which:

FIGS. 8*a*–8*f* show corresponding views for the lower bin operation configuration of FIGS. 7*a*–7*f*, when in the closed position;

FIGS. 10*a*–10*f* show respectively similar views for the lock plate member of the latch assembly of FIG. 1;

DETAILED DESCRIPTION OF THE INVENTION

A multi-application, automotive glovebox latch assembly is re-configurable with the same components in a snap-together assembly to meet a plurality of applications, for glovebox off-set handle (paddle) position and operation: The glovebox keeper hook remains in the middle of the glovebox. The versatility of this off-set latch assembly permits the latch assembly to be used in left-hand drive and right-hand drive automobiles and to permit ease of access to the glovebox release handle, i.e., glovebox paddle, by the driver as well as the passenger.

Figures 1A, 1B:
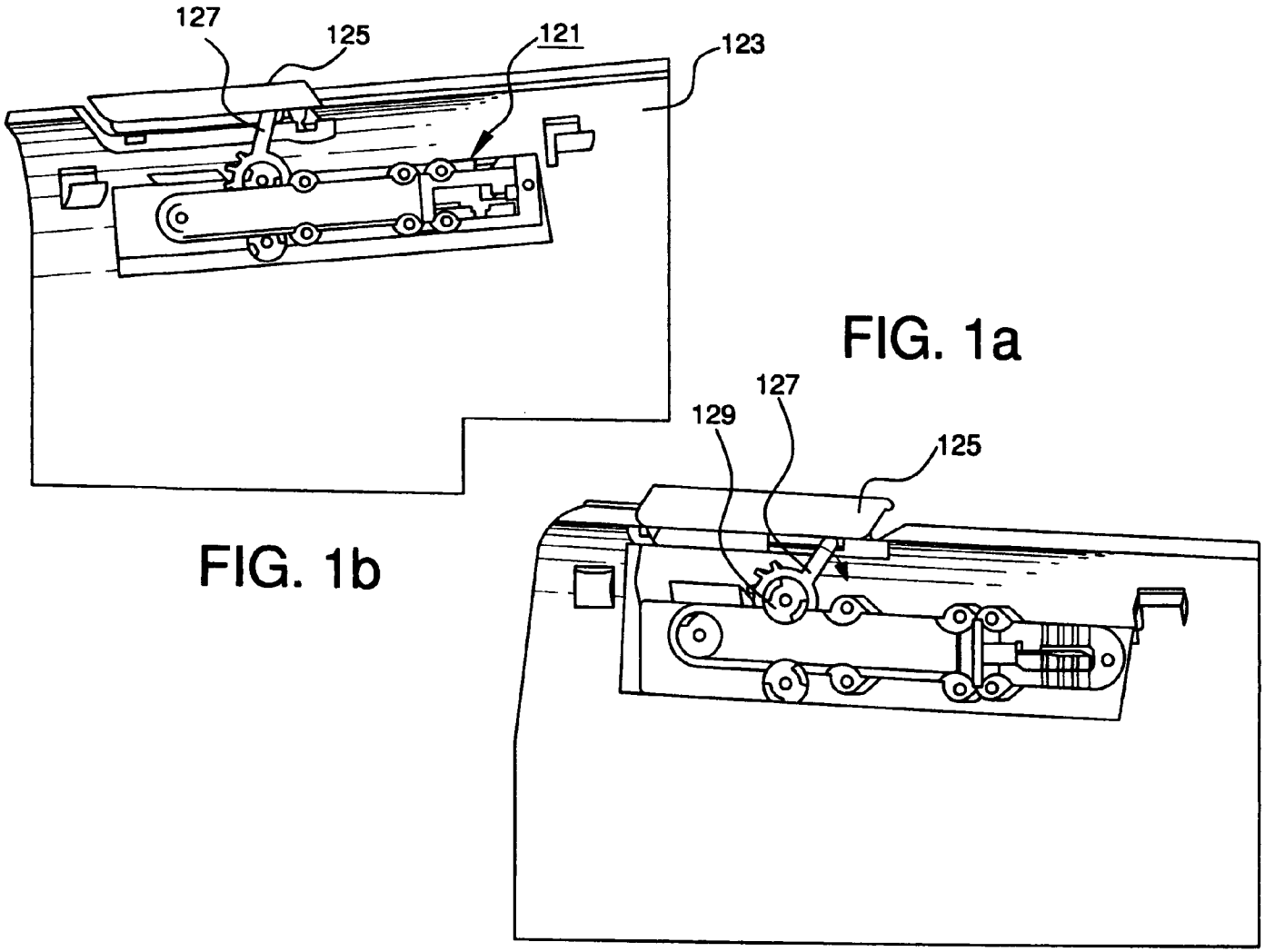
FIG. 1*a* is a pictorial perspective view of the latch assembly with the paddle in a closed position and a top bin structure with the flip-over activation mechanism present.
FIG. 1*b* is a pictorial perspective of the top bin structure of FIG. 1*a* with the paddle in the open position for opening the glovebox.

A pictorial perspective view, FIG. 1*a*, shows the latch assembly 121 mounted on a glovebox panel 123, with the paddle 125 in the closed position for an upper bin configuration. Protruding from the latch assembly is its actuator arm 127, which will be further discussed below. This arm 127 is a radially, outwardly extending cantilever the end of which can ride against the surface 126 of the handle/paddle 125, which when the handle 125 is moved moves the cantilever 127 and thereby rotates the gear 129, FIG. 2. The latch assembly 121 is elongate shaped to extend between the paddle 125 location and the location of the keeper hook 129 location. Included on the housing portion of the latch assembly 121 are a plurality of bosses 124 facilitating mounting for various configurations and installations.

The end of the actuator arm 127 is in contact with the inner face of the paddle 125 and rides along that face when the paddle 125 is pivoted by a passenger. A pictorial perspective view, FIG. 1*b*, shows the paddle 125 pivoted to move the actuator arm 127 in an arc path. The actuator arm 127 is mounted on and a part of a pinion gear 129 incorporated within the latch assembly 121. The installations illustrated in FIGS. 1*a* and 2*b* is for upper bin glovebox latch location operation.

Figure 2:
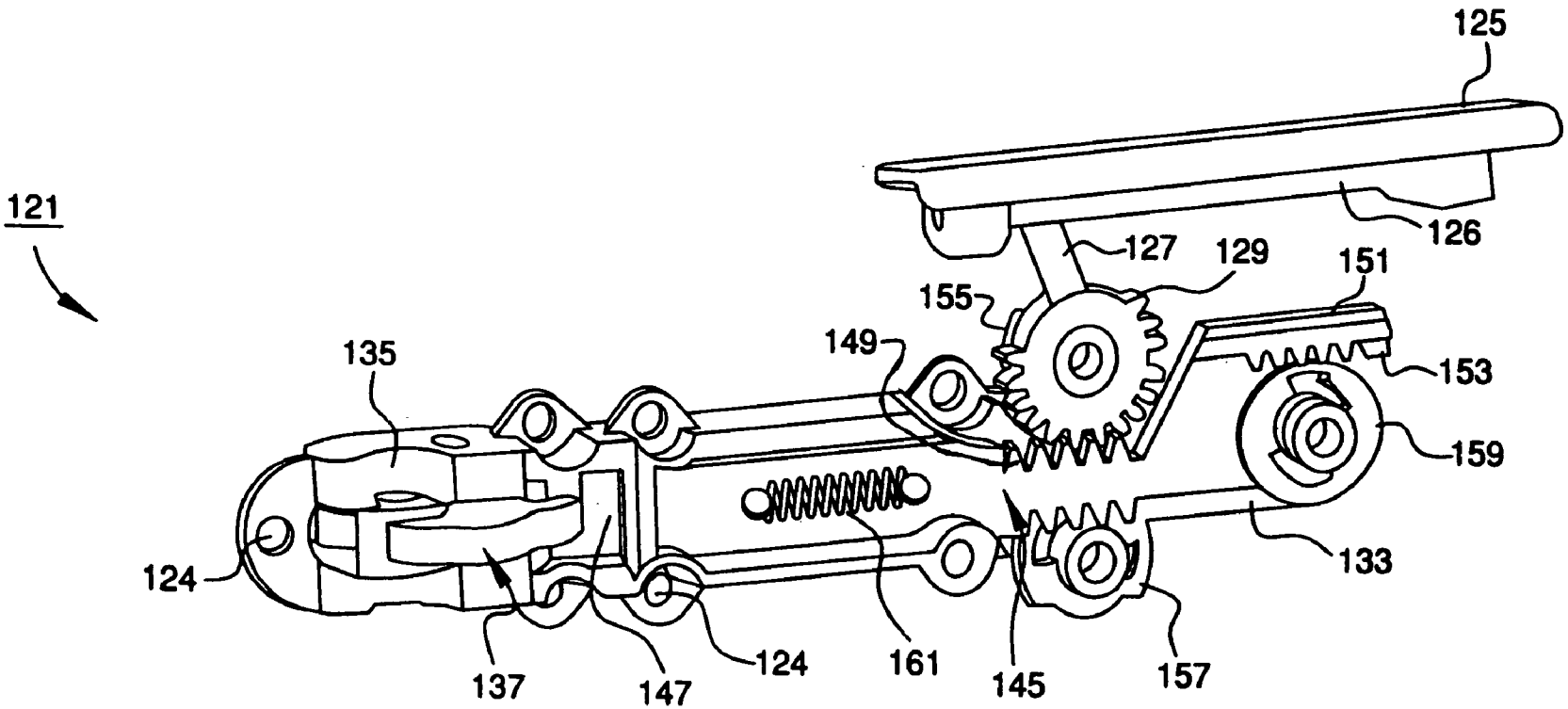
FIG. 2 is a pictorial perspective of the latch assembly operating against the bin paddle showing details of the various elements including the flip-over structure.

In the pictorial view, FIG. 2, which is a close-up perspective of the assembly 121 with the cover plate removed showing the assembly housing 133, for lower bin configuration. In this configuration, the handle can be fitted with a cylinder mechanism 134. This handle and lock mechanism 131 carries an abutment post 143 (shown in FIG. 8*a*), which can move downwardly from its rest position, and in turn acts against the side of the actuator arm 127, moving it downward to rotate this arm 127 and its associated gear 129.

Slidably operable within the housing 133 is a lock plate 145. The lock plate 145 has a blade portion 147 at its end located with the housing curved hook-like flange 135. The opposite end of the lock plate 145 has a first gear track 149 section on its edge, and a dog-leg shaped off-set arm 151 carrying a second gear track 153 section facing in the opposite direction from the first track 149.

The off-set arm 151 carries its respective second gear track 153 section with the teeth facing the longitudinal centerline of the housing 133. A first pair of pivot posts or bushing journals 155, 157 are located on the housing 133 in the region of the first gear track 149 at opposite outboard edges of the housing 133. The pinion gear 129 is selectably mountable to either of these journals 155, 157 depending upon right-hand or left-hand handle (paddle) 125 positioning. A third pivot post or bushing journal 159 is located at the extreme end of the housing 133, adjacent the second gear track 153 section.

A return spring 161 biases the lock plate 145 with its blade 147 against the pawl 137 end of the housing 133. In the configuration shown in FIG. 2, the lock plate 145 must be turned over for opposite hand installation and operation. The pinion gear 129 can be held onto a respective journal 155, 157, 159 by a snap ring or other quick installation and release mechanism.

Figure 3:
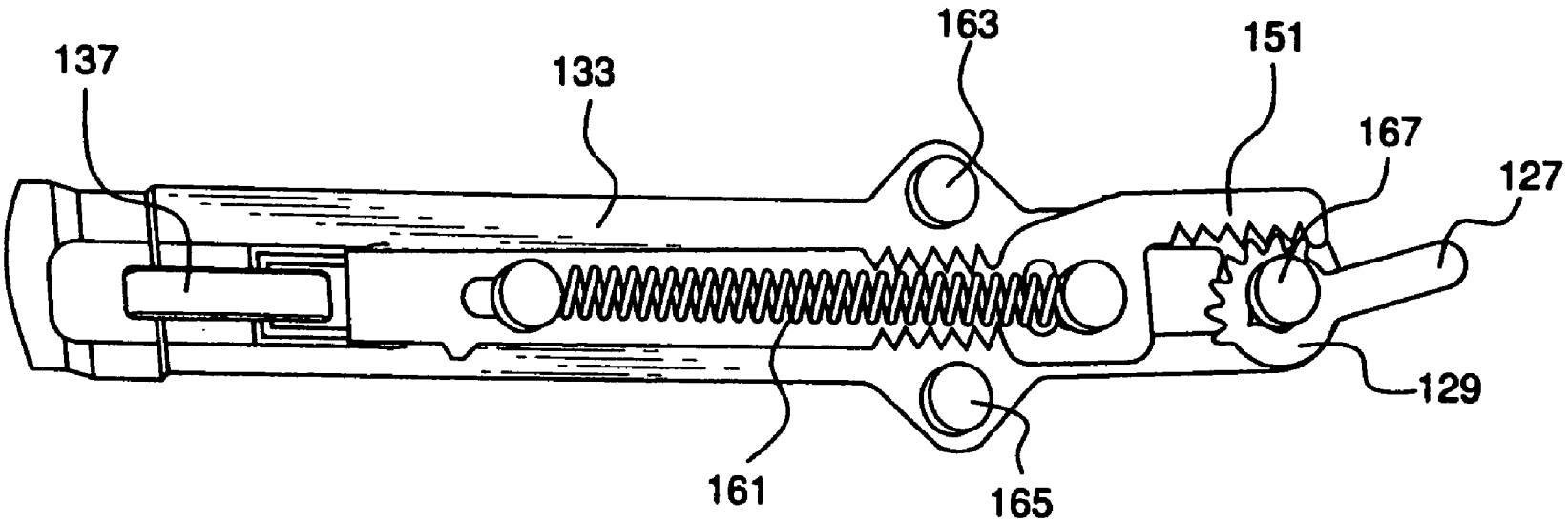
FIG. 3 is a pictorial plan view of the sliding lock plate flipped-over for right hand replacing left hand operation of the flip-over structure latch assembly.
Figure 4:
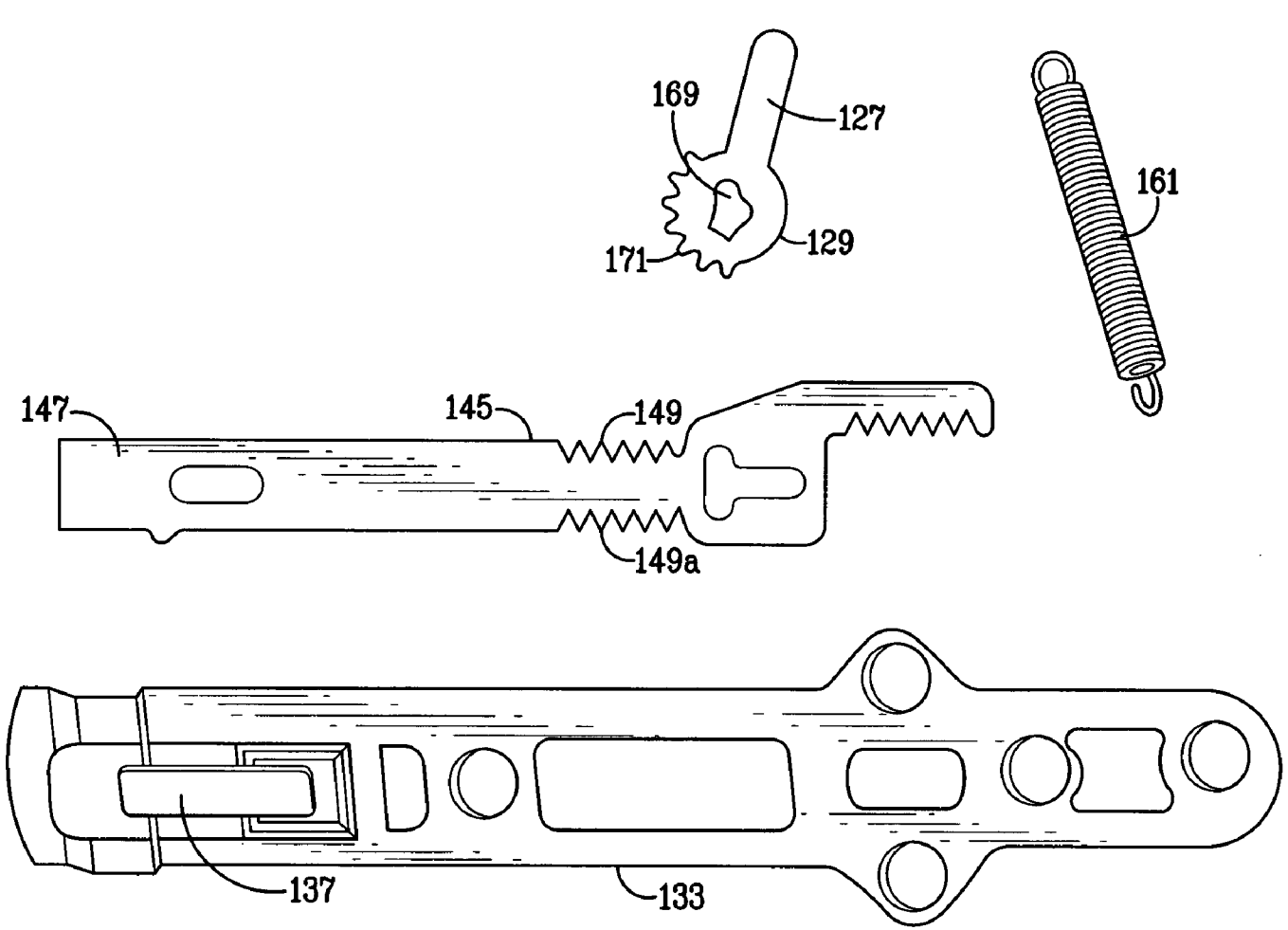
FIG. 4 is a pictorial plan view, partial disassembly of the latch assembly of FIG. 3.
Figure 5A:
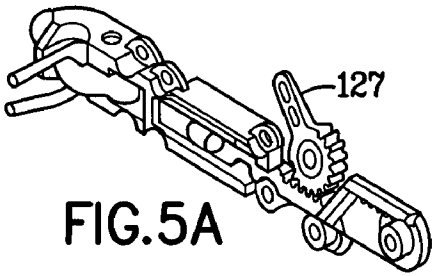
FIGS. 5*a*–5*f* are a perspective view, top view, bottom view, side view, pawl end view, and gear track end view of the latch assembly of FIG. 1 in the open position for upper bin operation.
Figure 5B:
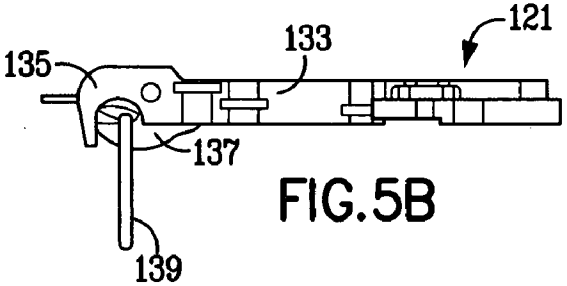
Figure 5C:
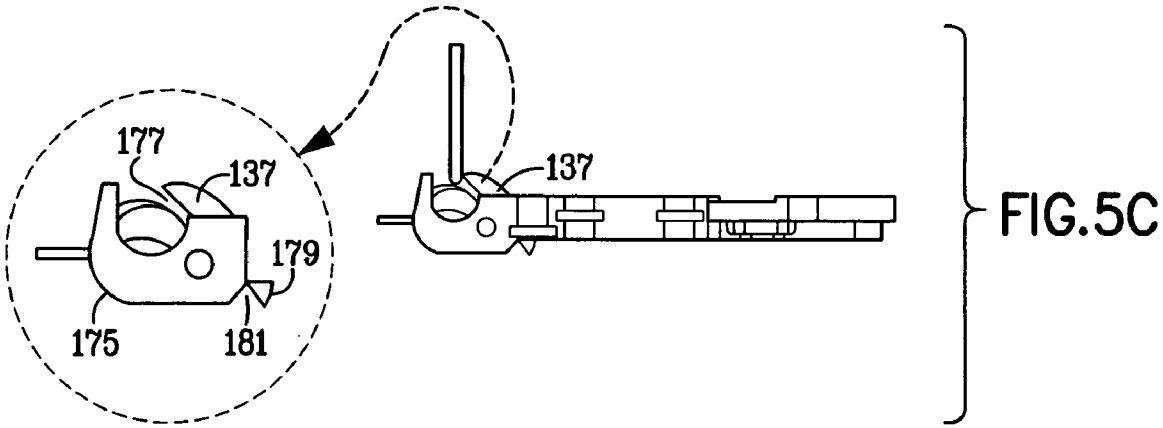
Figure 5D:
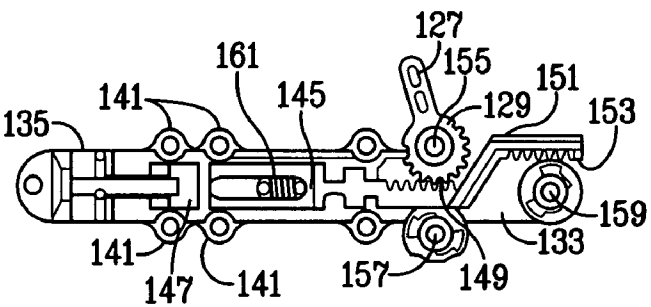
Figure 5E:
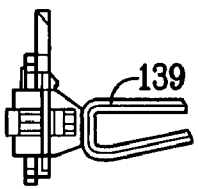
Figure 5F:
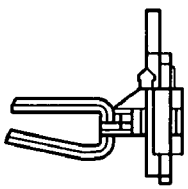
Figures 6A, 6B, 6C, 6D, 6E, 6F:
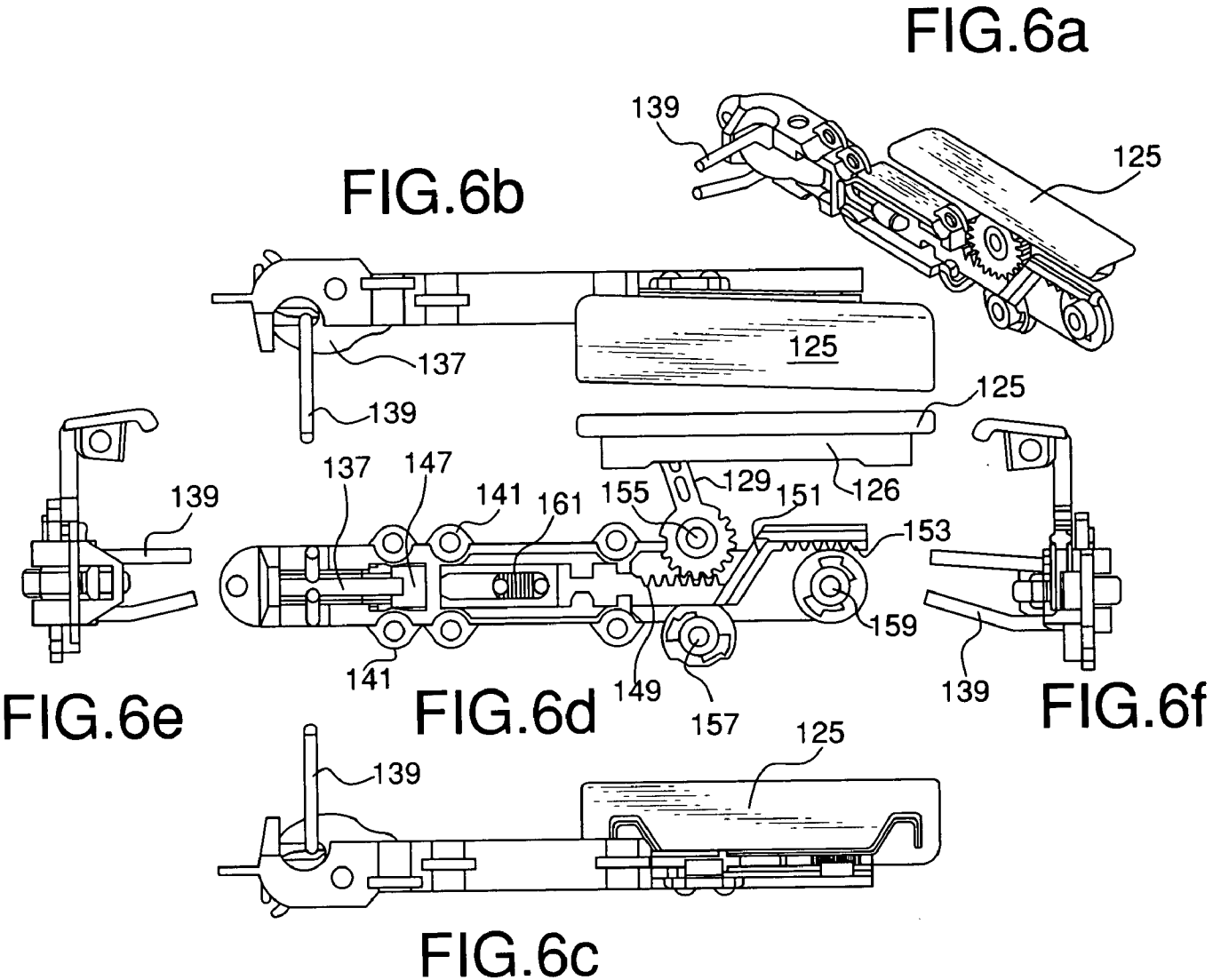
FIGS. 6*a*–6*f* show corresponding views of the latch assembly of FIGS. 5*a*–5*f* for upper bin operation in the closed position.

FIG. 3 is a pictorial plan view of the sliding lock plate 133 flipped over for right hand replacing left hand operation of the flip-over structure latch assembly. FIG. 4 shows a pictorial plan view of a partial disassembly of the major components of FIG. 3. Pivot posts carry a pair of keys 163, 165, 167 at each of their outer ends. These keys are positioned at about 120 degrees from each other. The pinion gear 129 has a matching bore 169 which has a pair of keyways 171 on it to accept the any of the pair keys. The pinion gear 129 path 173 traverses an arc of about 120 degrees. By off-setting the operational rotation of the pinion from its installation orientation on a respective keyed 163, 165, 167 post, the pinion can be installed and operated against a respective selected gear track 149, 151 without the use of snaps, snap rings or other separate holding means.

Figures 7A, 7B, 7C, 7D, 7E, 7F:
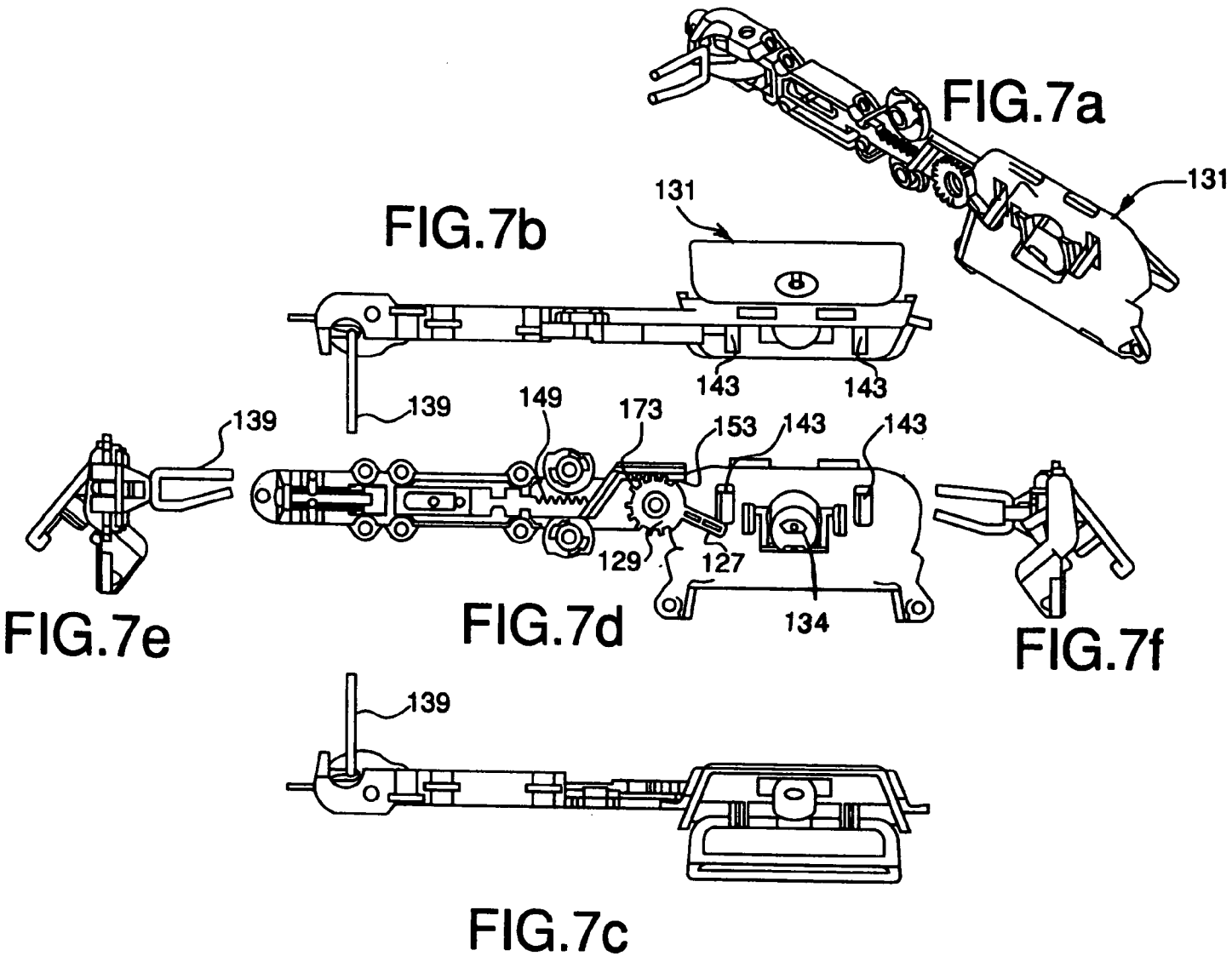
FIGS. 7*a*–7*f* show the latch assembly of FIG. 1 in perspective view, top view, bottom view, side view, pawl end view and gear end view, respectively, when configured for lower bin operation and in the open position.
Figures 9A, 9B, 9C, 9D, 9E, 9F:
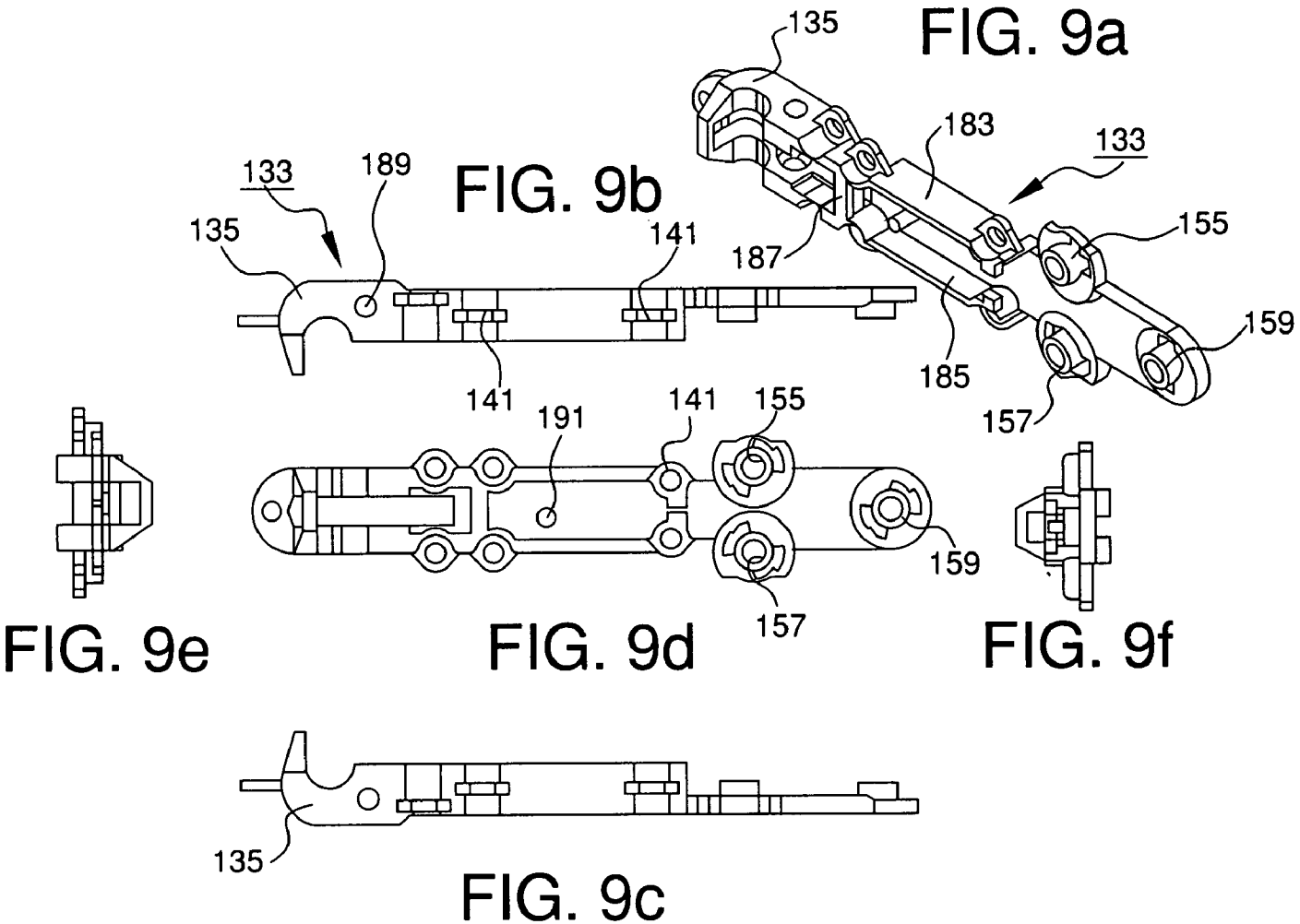
FIGS. 9*a*–9*f* show respectively the same views for the housing member of the latch assembly of FIG. 1.

The latch assembly FIGS. 7, 8 has a first gear track section 149, 149*a* on each opposite edge of the lock plate 145. This eliminates the need to turn the lock plate over when switching between left-hand and right-hand operation configurations.

FIGS. 5*a*–5*f* are respectively perspective, top, bottom, side, pawl end, and pinion gear end views of the latch assembly 121. The keeper hook 139 is not engaged because the pinion gear 129 has rotated to retract the lock plate 145 by means of its action against the first gear track 149 section. The return spring 175 associated with pawl 137 has rotated the pawl 137 to the open position. The pawl 137 and its return spring 175 are shown in the partial detail of FIG. 5*c*.

The curved slot 177 in the pawl 137 captures the keeper hook 139 when the pawl 137 approaches the keeper 139 tangentially as the glovebox is closed. This causes the pawl 137 to rotate. The end of the blade 147 is normally in contact with the cam surface 179 on the pawl 137. When fully closed, the blade 147 slides past the end of the pawl 137 cam 179 and moves into a locking position beyond the cam 179 to bear against the lock shoulder 181 of the pawl 137. Thereby the latch assembly is locked as shown in the various views of FIGS. 6*a*–6*f*. Also shown in FIGS. 6*a*–6*f* is the glovebox panel paddle 125 and it abutment flange 126.

FIGS. 7*a*–7*f* show respectively, perspective, top, bottom, side, pawl end and gear end view of the latch assembly configured for lower bin installation and with the latch open, while FIGS. 8*a*–8*f* show the same respective view lower bin configuration with the latch closed. In this configuration the handle and lock mechanism 131 are shown, including the abutment post 143 which is moved downward to rotate the cantilevered actuator arm 127 carried on the pinion gear 129.

The pinion gear 129 held on by cap-type snaps or snap rings, or other similar means. The pinion gear path 173 (gear teeth) traverse an arc of about 270 degrees. This longer arc of the pinion gear 129 teeth eliminates the need to turn the pinion over between left-hand and right hand applications, and permits for greater flexibility of adjustment for application to various configurations and differences in types of paddles 125 and handle and lock mechanisms 131.

FIGS. 9*a*–9*f* show the same respective selection of view as FIGS. 7*a*–*f* and 8*a*–*f* for the housing 133. The housing 133 side walls 183, 185 in the middle portion of the housing 133, and the enclosure bar 187 at the blade operating region of the housing 133. Also seen on the base of the curved hook flange 135 is the pawl rotation pin, which holds one end of the pawl 135 return spring 175. A lock plate guide way pin 191 extends outwardly from the back wall of the housing 133 towards the operating location of the lock plate 145.

FIGS. 10*a*–10*f* show respective detail views of the sliding lock plate in the same order as previous views. The lock plate 145 includes the blade end 147 at a first end, and at the other end, the first gear track 149, and the off-set arm 151 carrying the second gear track 153. The lock plate return spring 161 attaches to the lock plate 145 at on of opposite face mounted notched spring posts 193, 195, depending upon the left hand or right hand configuration selected. The housing 133 guide way pin 191 extends through an elongate slot 197 in the face of the lock plate 145. The position and length of this slot 197 determines the "throw" of the lock plate 145.

Figure 11:
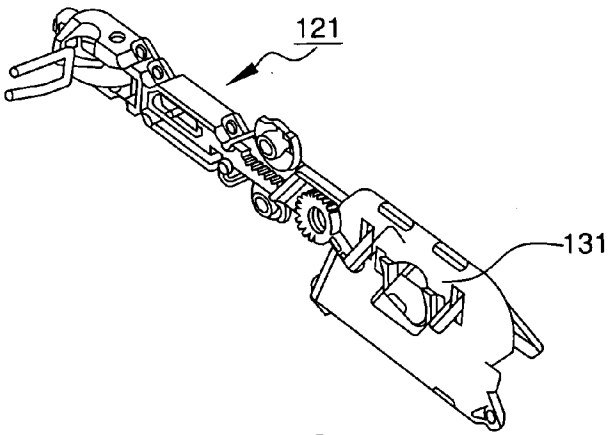
FIG. 11 shows a perspective view of a lower bin configuration of the latch assembly in the unlocked position.
Figure 12:
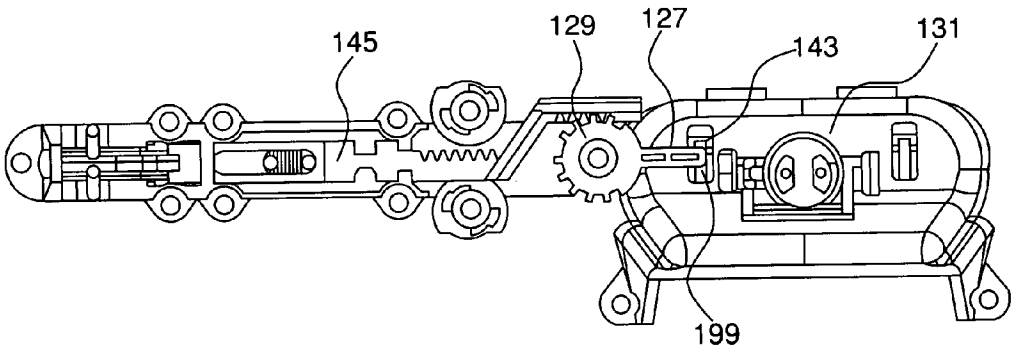
FIG. 12 shows a side view of the configuration of FIG. 11 in the closed and locked position with a lock mechanism.

FIG. 11 shows a perspective, assembled view of the latch assembly 121 operating with a handle and lock 131 of a lower bin configuration and the lock open for left hand installation. FIG. 12 illustrates a side view of the latch assembly configuration of FIG. 11, in the closed and locked position. A locking mechanism 199 is engaged against the cantilever arm 127. Thereby the pinion gear 129 and the lock plate 145 are held fixed.

Figure 13:
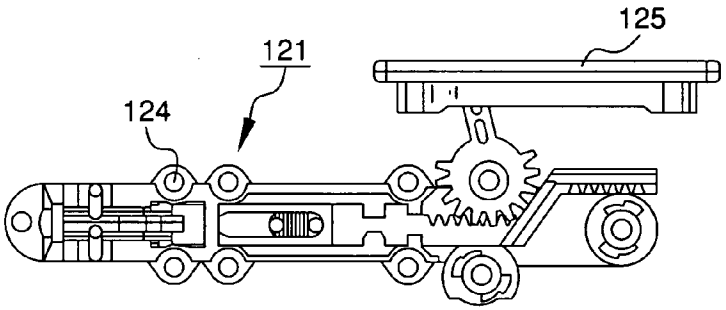
FIG. 13 shows a side view of the latch assembly configured for upper bin operation with left-sided vehicle steering wheel.
Figure 14:
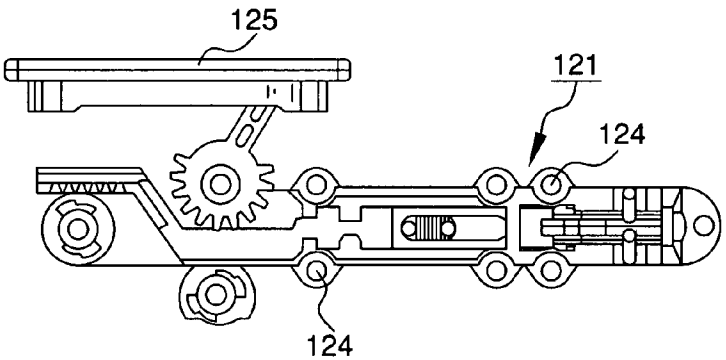
FIG. 14 shows a side view of the latch assembly configured for upper bin operation with a right-sided vehicle steering wheel.

FIG. 13 illustrates the upper bin configuration with a left-handed paddle 125 position. FIG. 14 illustrates the lower bin configuration for the latch assembly 121 with a right-handed paddle 125 position.

By modifying the assembly with the interchange of two components, the pull handle (paddle) and the cam operated by the handle from a pocket cam to a paddle cam, the assembly can be reconfigured from lower bin operation assembly to upper bin operation assembly.

Figure 15:
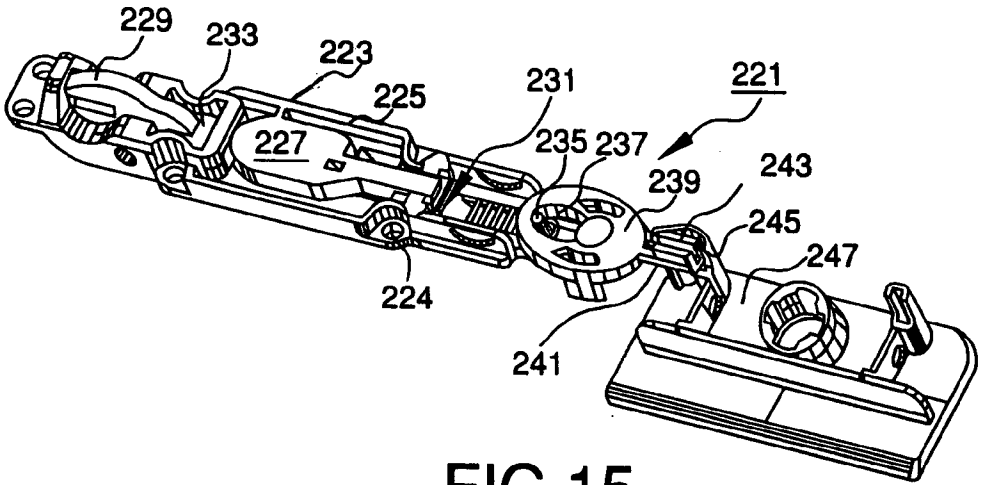
FIG. 15 is a perspective view of the latch assembly of FIG. 1 now configured for the pocket cam activation mechanism and for lower bin mounting and assembly for left-hand operation.

A pictorial perspective view, FIG. 15, view of the latch assembly 221 of FIG. 1, now configured with the pocket cam activation mechanism for lower bin and left-hand operation also shows the operator handle 247. The latch assembly 221 includes an elongate housing 223 which is essentially rectangular in shape having side walls 225 in a region which encloses a damper mechanism 227. A standard claw-type pawl 229 is mounted for operation at one end of the housing 223. This pawl 229 is spring biased to the open position, and includes camming surfaces which enables it to engage and lock against a keeper. Carried to slide longitudinally within the housing 223 is a lock plate 231. This lock plate 231 has a pawl-engaging blade 233 at the pawl 229 end, and a cam follower pin 235 at the other end.

The cam follower pin 235 engages the pocket camming surface 237 of an oval-shaped pocket cam 239. Projecting radially, outwardly from the side of the cam 239 away from the pawl 229 is a finger 241. This radially projecting finger 241 carries a pair of abutment plates 243 to be engaged by a projecting shoulder 245 or like member on the operating handle 247.

Because the latch assembly 221 is symmetrical about its longitudinal axis, it can be reversed between left-hand and right-hand operation.

Figure 16A:
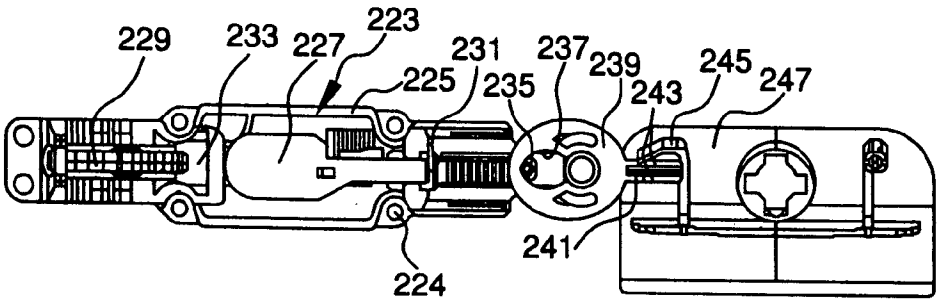
FIG. 16*a* is a plan view of the latch assembly of FIG. 15.
Figure 16B:
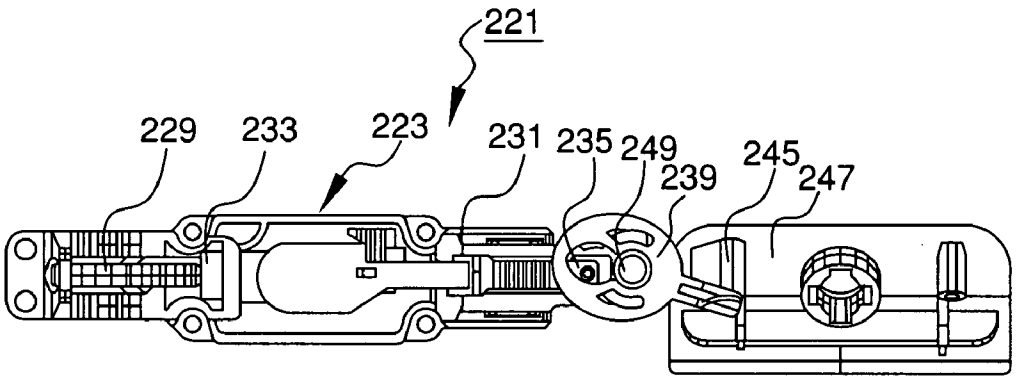
FIG. 16*b* is a plan view of the latch assembly of FIG. 15 with the handle (paddle) pulled to rotate the pocket cam and thereby cause the lock plate to disengage from the pawl.

FIG. 16*a* shows a plan view of the latch assembly 221 of FIG. 15. When the handle 247 is rotated by an operator, as can be seen in FIG. 16*b*, the handle projecting shoulder 245 moves the pocket cam projecting finger 241 downward (for left-handed operation). This causes the pocket cam 239 to rotate clockwise on its pivot journal 249. The pocket cam 239 is mounted to the end of the lock plate 231, opposite the blade 233 end, by engagement with and mounting for rotation on the journal pin 249.

The pocket cam surface 237 is oval shaped. As the cam 239 rotates further, the cam follower pin 235 is moved towards the handle 247, which as it is attached to the lock plate 231, carries the lock plate 231 towards the handle 247 and withdraws the lock plate blade end 233 from holding engagement with the pawl 229. This permits the pawl 229 to swing open under its spring biasing. For right-handed operation the latch assembly is turned around (i.e., the handle 247 is positioned to the opposite side of the latch 221.

Figure 17:
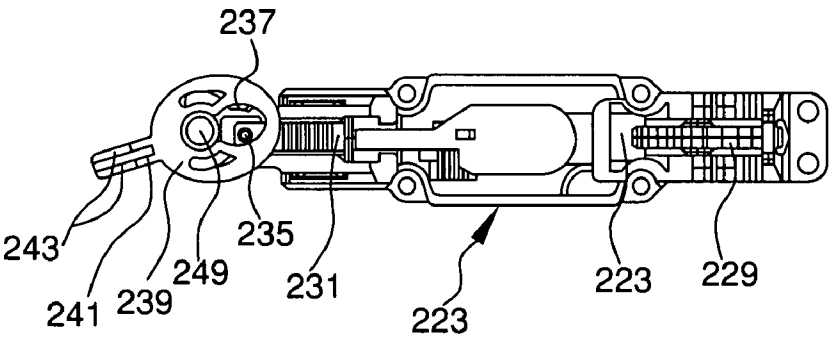
FIG. 17 shows the rotation of the pocket cam of FIGS. 16*a*, 16*b* for right-handed operation.

FIG. 17 shows a configuration correct assembly for right-handed operation. For right-hand operation the pawl 229 is on the right and the handle 247 (not shown here) is on the left of the view. In a right-hand configuration, the cam 39 is rotated in the opposite direction (counter-clockwise). However, the symmetrical construction of the latch assembly 221 and of the pocket camming surface 237 permits the latch assembly to be switched between right and left hand installations with any reconfiguration. Any rotation of the pocket cam 235 results in the opening of the latch assembly 221 by withdrawing the blade 233 from the spring biased pawl 229.

Figure 18A:
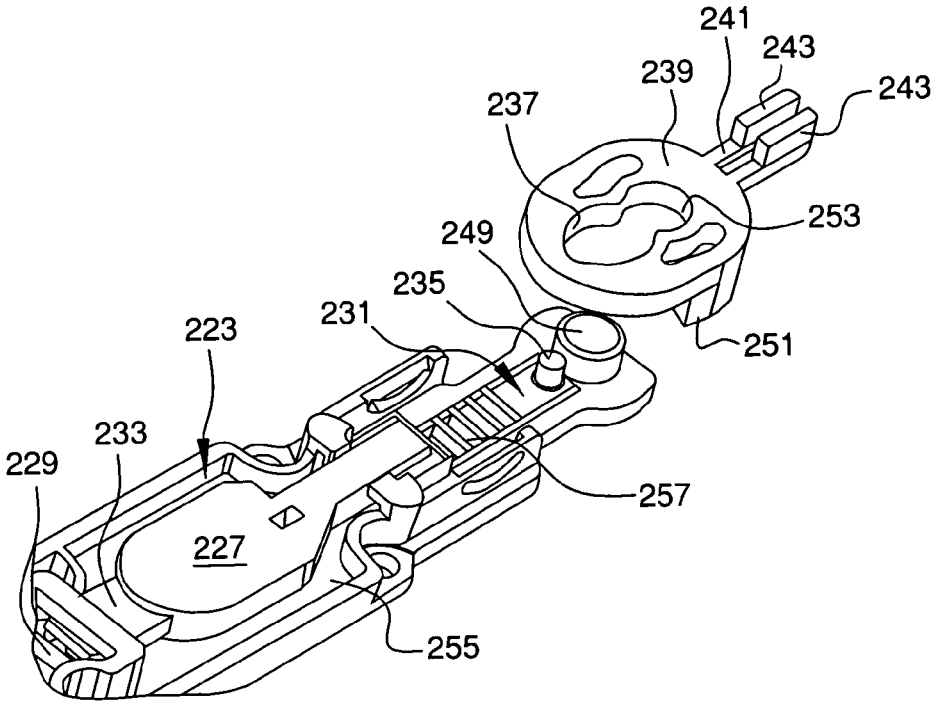
FIG. 18*a* is a perspective partial disassembly view of the pocket cam, slide plate, housing and damper casing of FIG. 15 as ready for assembly.
Figure 18B:
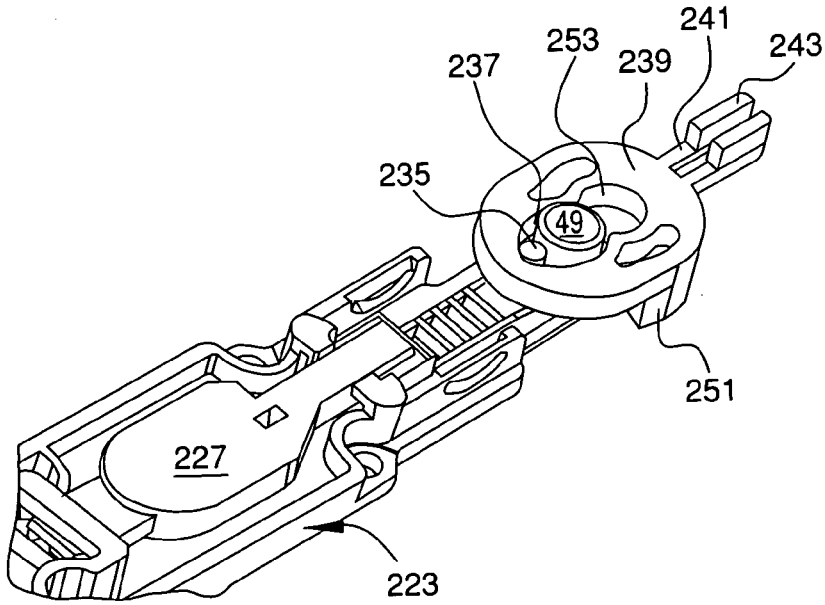
FIG. 18*b* is a partial assembly view of the structure of FIG. 15.
Figure 18C:
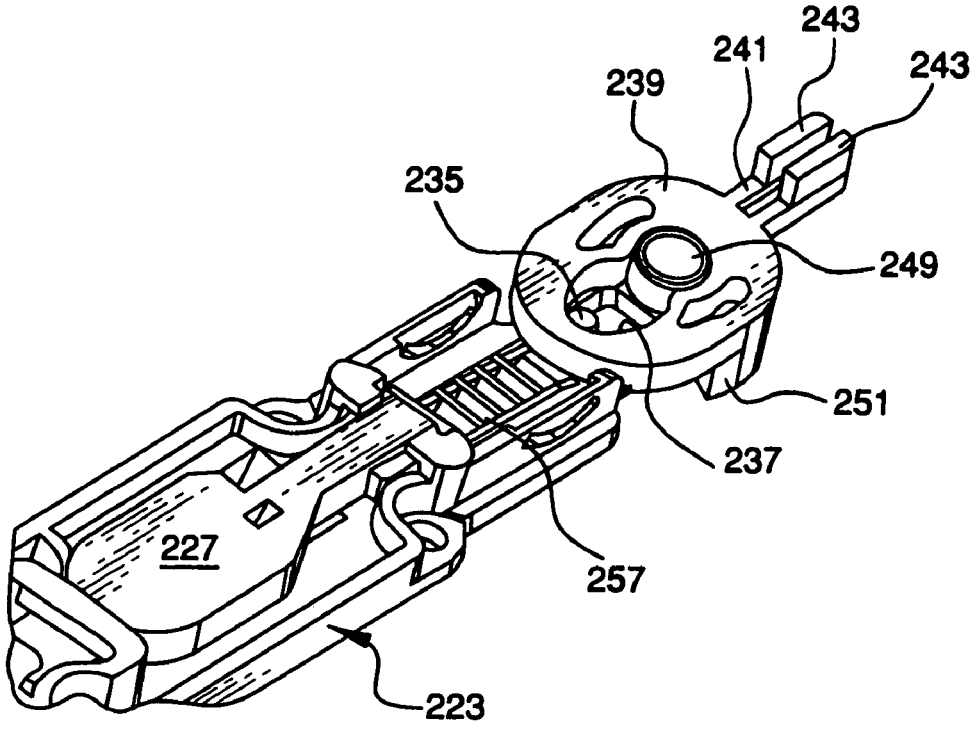
FIG. 18*c* is a further assembly view of the structure of FIG. 15.

FIGS. 18*a*, 18*b* and 18*c* illustrate the snap together assembling features of the latch assembly 221 of FIG. 15. FIG. 18*a* is a partial detail view of the pocket cam 239 shape and the adjacent portion of the housing 223. The cam 239 has curved shoulder 253 that surrounds a substantial portion of the pivot journal 249. The slidable lock plate 231 is spring biased to the blade 233 engaged position with the pawl 229. Therefore, the cam follower pin 235 is maintained in pressure contact with the pocket camming surface 237 of the cam 239. While this cam surface 237 can be implemented with various curves, the cam curve is symmetrical with respect to the longitudinal axis of the assembly. The shape of the cam surface 235 is oval as shown in FIGS. 18*a*–18*c*.

The curved shoulder 251 rides against the outside surface of the journal pin 249 under the spring force transferred through the lock plate 231, thereby the cam follower pin 235 exerts pressure against the camming surface 237. This shoulder 251 is implemented with juxtaposed pairs of projecting walls and adds stability to the pivoting operation of the cam 235.

The opening in the cam 239 is liken to a figure "8" shape, that being two lobes opening onto one anther. The pivot lobe 253 is circular-shaped, while the camming lobe 237 is oval-shaped, FIGS. 18*a*, 18*b*.

The housing 223 side walls 225 help form a slot 255 in the housing into which the sliding lock plate 231 is inserted to slide there within. The lock plate 231 interacts with a damper mechanism 227 positioned in the middle of the housing 223. The sliding lock plate 231 also carries a plurality of teeth 257 such as to form a rack at the cam follower pin 235 end thereof.

Figure 19:
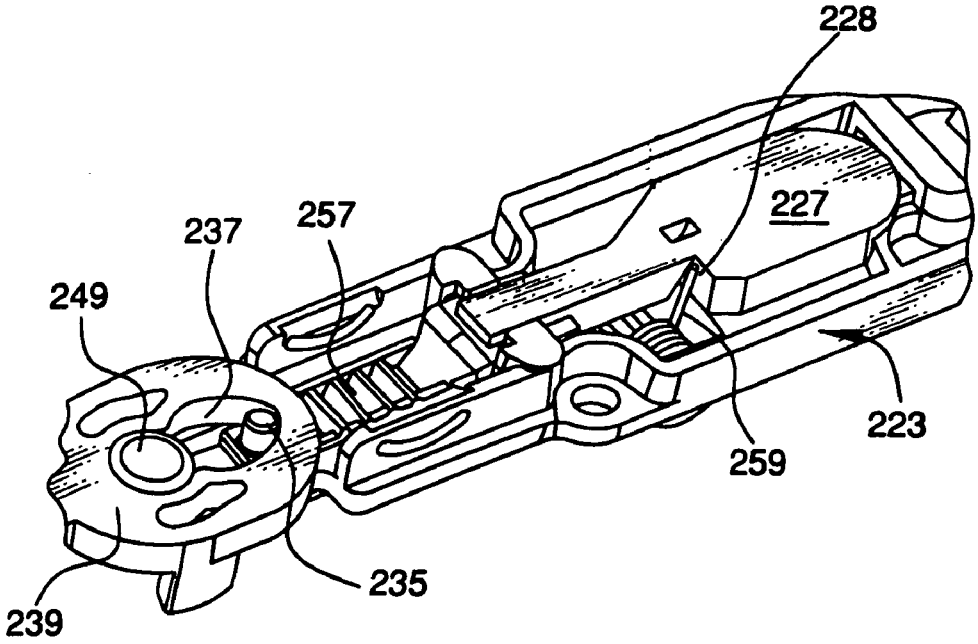
FIG. 19 shows a detail partial perspective view of the slide plate biasing torsion spring from a reverse direction.

FIG. 19 is an close-up partial view which for right-hand configuration which shows the pocket cam 239 being positioned over its pivot pin or journal 249 with the cam follower pin 235 in contact with the pocket cam surface. Where the cam 239 and the journal 249 are made of plastic or similar pliable material, this structure can be assembled by snap fit.

The lock plate 231 and the components mounted thereon are biased towards the pawl 229 by a coiled torsion spring 259. This spring 259 has an end pressing against an end wall 228 of the damper mechanism 227 mounted on the lock plate 231.

Figure 20:
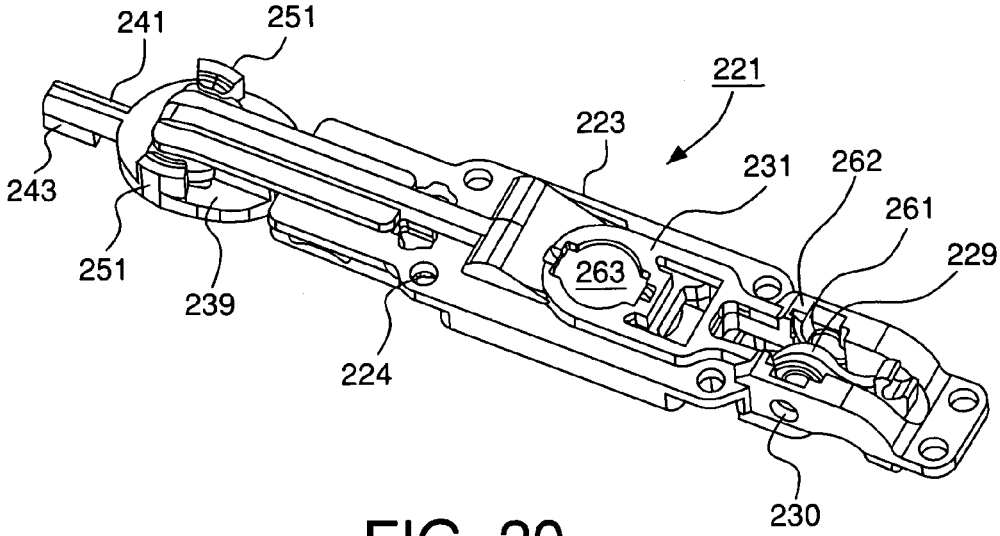
FIG. 20 is a perspective view of the reverse side of the latch assembly of FIG. 15.
Figure 21:
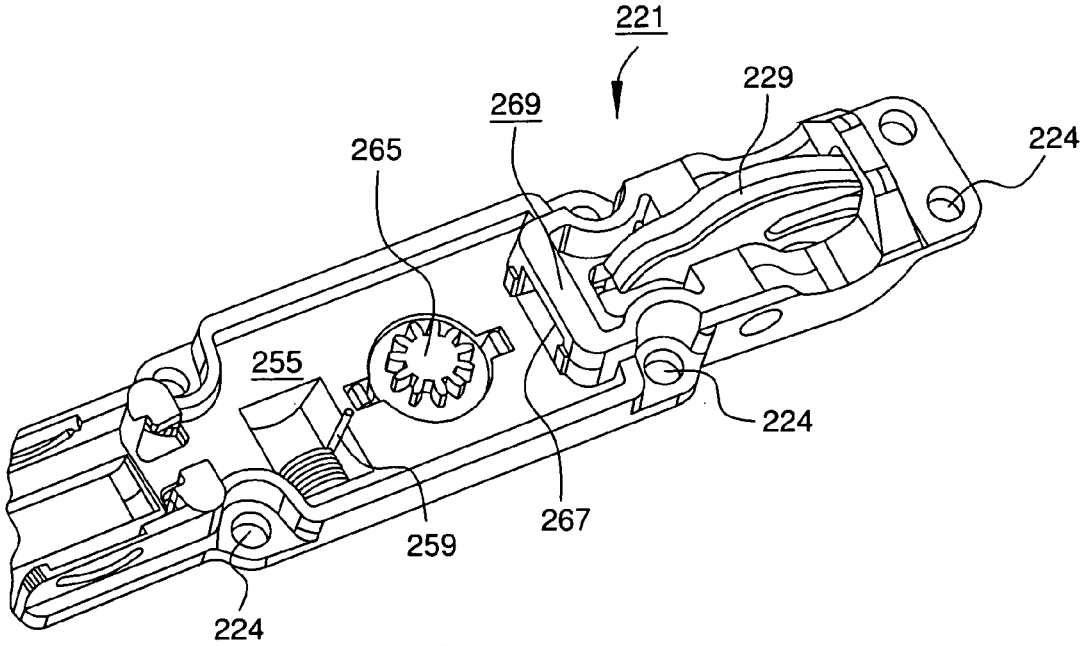
FIG. 21 is a partial perspective detail view of the clutch dampened pinion gear of FIG. 19 with its cover removed.

The latch assembly 221 of FIG. 15 is shown in a back/bottom back perspective view in FIG. 20. The pawl 229 is shown with its biasing coil, torsion spring 261 having the tail of the spring 261 abutting a face 262 of the housing opening in which the pawl 229 rotates via an axle or pivot pin 230. The damper mechanism 227 is positioned in a receiving hole 263 in the back face of the housing 223. This damper mechanism 227 operates to regulate the lock plate 231 velocity, when the lock plate 231 is under the force of the return spring 259, and operates to reduce any noise. The damper mechanism 227 includes a pinion gear 265, FIG. 21, connected to a friction clutch 271 (not shown in this figure). The gear 265 intercepts a toothed portion 275 of the lock plate 231, shown in FIG. 23, as the gear 265 extends the opening 273. The lock plate 231 blade member 233 extends through a housing slot 267 formed by a bridge wall 269 adjacent the pawl 229, as shown in FIG. 21.

Figure 22:
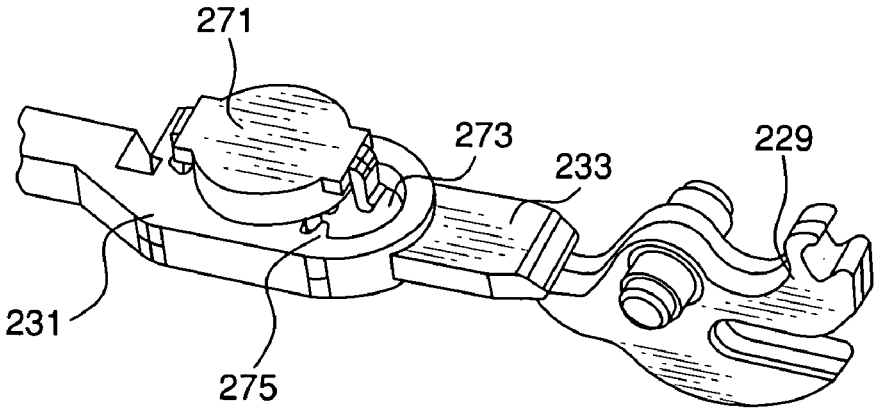
FIG. 22 shows a partial perspective detail view of the engagement of the lock plate with the pawl and the respective position of the damper that moves within a cavity of the housing.

The friction clutch 271, FIG. 22, is of standard design and is connected to the pinion gear 265. The lock plate 231 contains a cavity 273 in its central body portion, into which the pinion gear 265 extends to engage the several inwardly projecting teeth 275 which form a track of teeth on the sliding lock plate 231. The sliding lock plate cavity 273 teeth are therefore part of the friction clutch 271 pinion gear 265 sub-assembly implementing the damper function.

Figure 23:
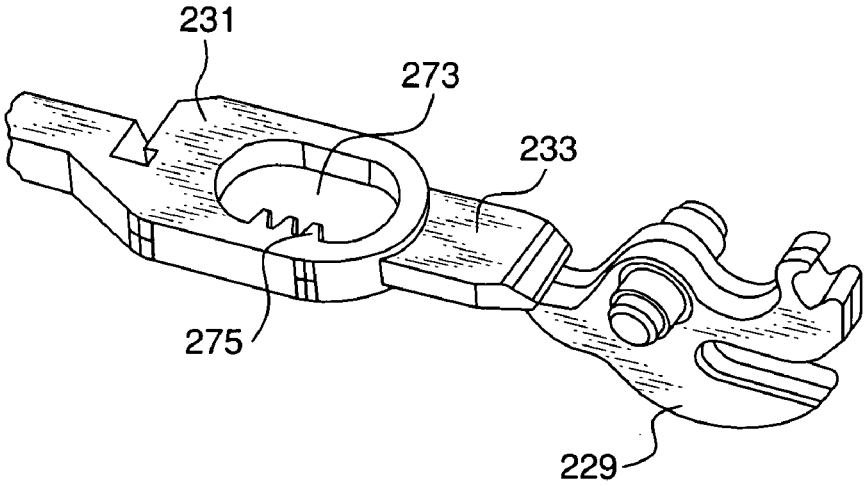
FIG. 23 is a partial perspective detail view of the slidable lock plate track teeth for engagement by the pinion gear of the damper.

FIG. 23 illustrates the sliding lock plate 231 cavity 273 in which the track teeth 275 extend inwardly from one side edge. The cavity or opening 273 is oval-shaped. The length of this cavity affects the "throw", i.e., length of movement, of the sliding lock plate 231. The number of teeth 275 is sufficient for the length of travel of the sliding lock plate 231.

As recited above, a change in the handle 247 and the cam 239 is almost all that is needed to convert the latch assembly 221 from lower bin configuration to upper bin configuration. Of course the housing 223 includes cavities, formed members and shoulders, as well as a plurality of mounting bosses 224, which may be used in one operation and not the other. However, these cavity shapes do not generally interferer when the latch assembly 21 is converted.

Figure 24A:
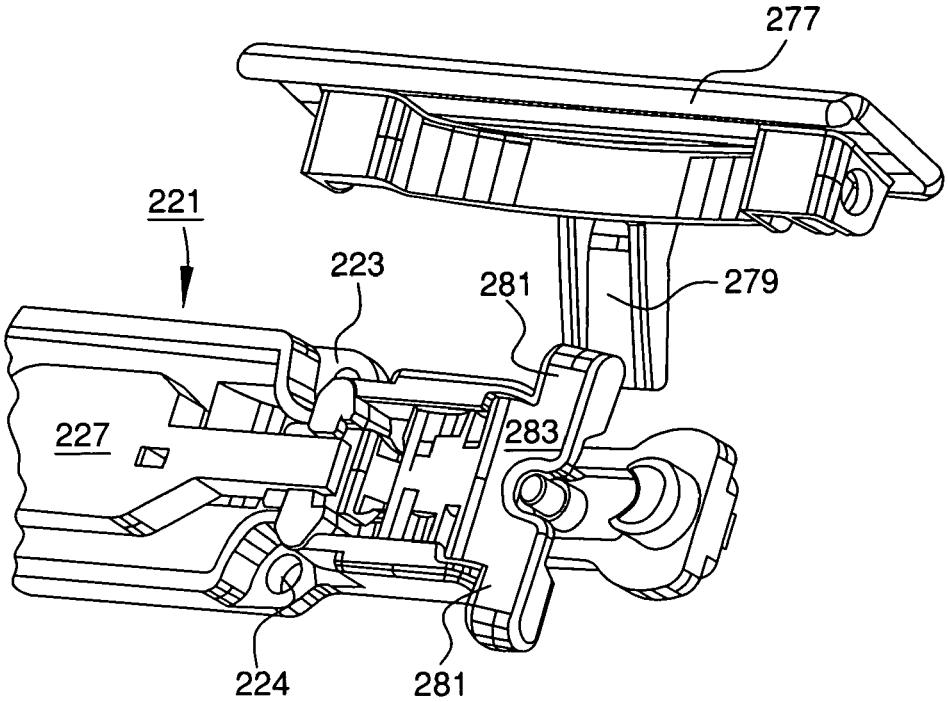
FIG. 24*a* is a partial perspective view of the handle projecting shoulder disengaged from the paddle cam which has been substituted for the pocket cam of FIG. 15.
Figure 24B:
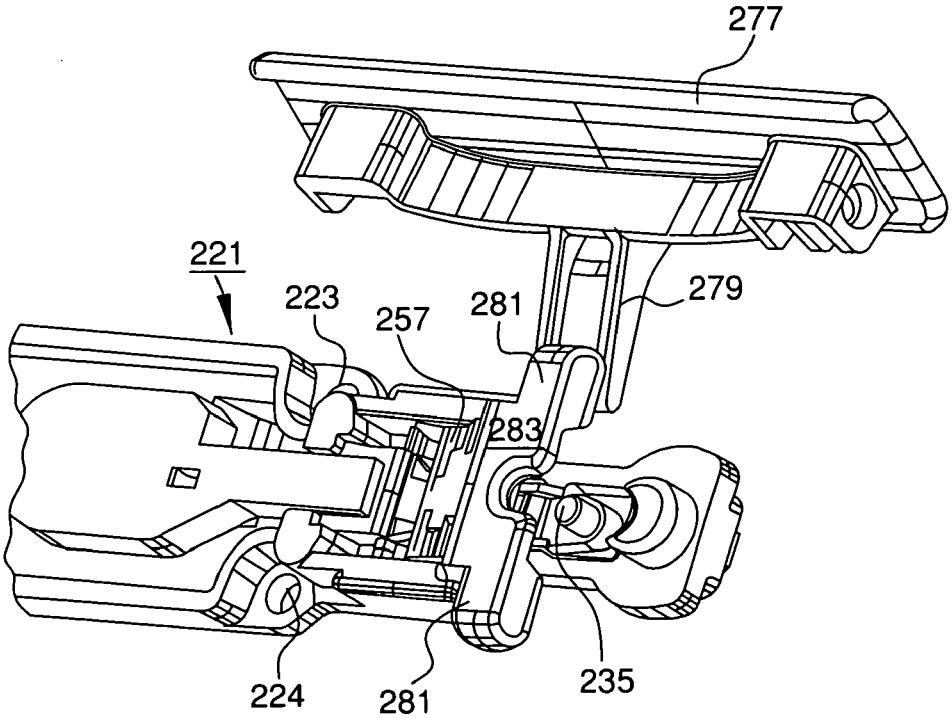
FIG. 24*b* is a partial perspective view of FIG. 24*a* with the handle projecting shoulder engaging the paddle cam transverse projection.

For upper bin configuration, the handle 277, FIGS. 24*a*, 24*b*, includes a large projecting shovel-shaped arm 279, which engages the mating structure of the latch assembly 221. Specifically, this arm 279 engages and moves a projection 281, being one of two lateral projections 281 on a symmetrical paddle cam 283. That projection 281 end of the cam 283 provides a T-shaped paddle cam 283, FIGS. 24*a*, 24*b*, 27*a*, 27*b*. The paddle cam 283 is mounted in the housing 223 to rock upward under the movement of the handle 277 arm 279, FIG. 24*b*, 2727*a*. When this occurs a gear portion 289 on the body of the paddle cam 283 engages a track of teeth 257, FIGS. 26, 27*a*, extend from the face of the sliding lock plate 231. When the paddle cam 283 rotates, its gear teeth 289 move the lock plate track teeth 57, thereby moving the sliding lock plate 231 away from the pawl 229.

Figure 25:
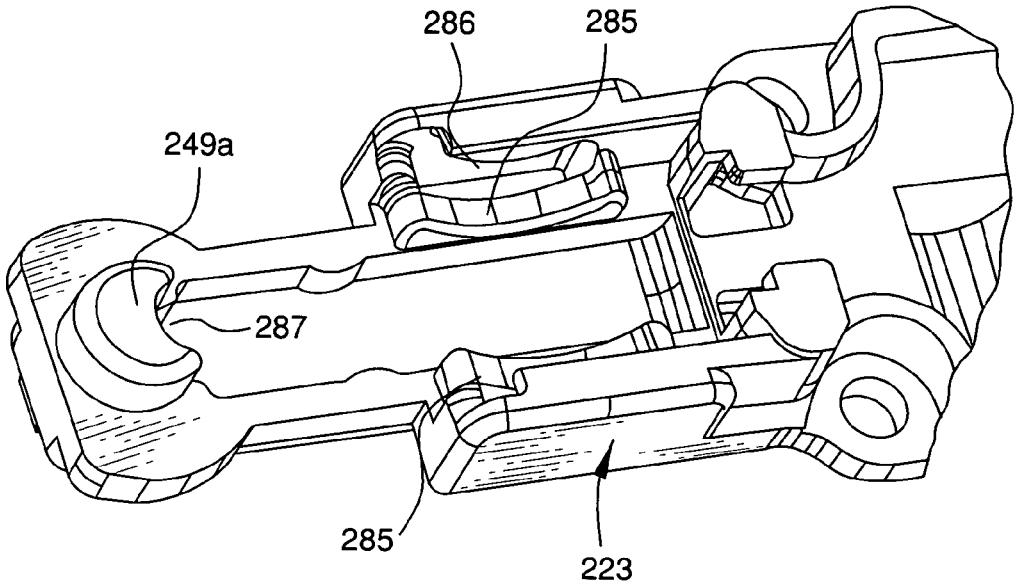
FIG. 25 is a partial perspective view of the paddle cam end of the housing for upper bin configuration.
Figure 26:
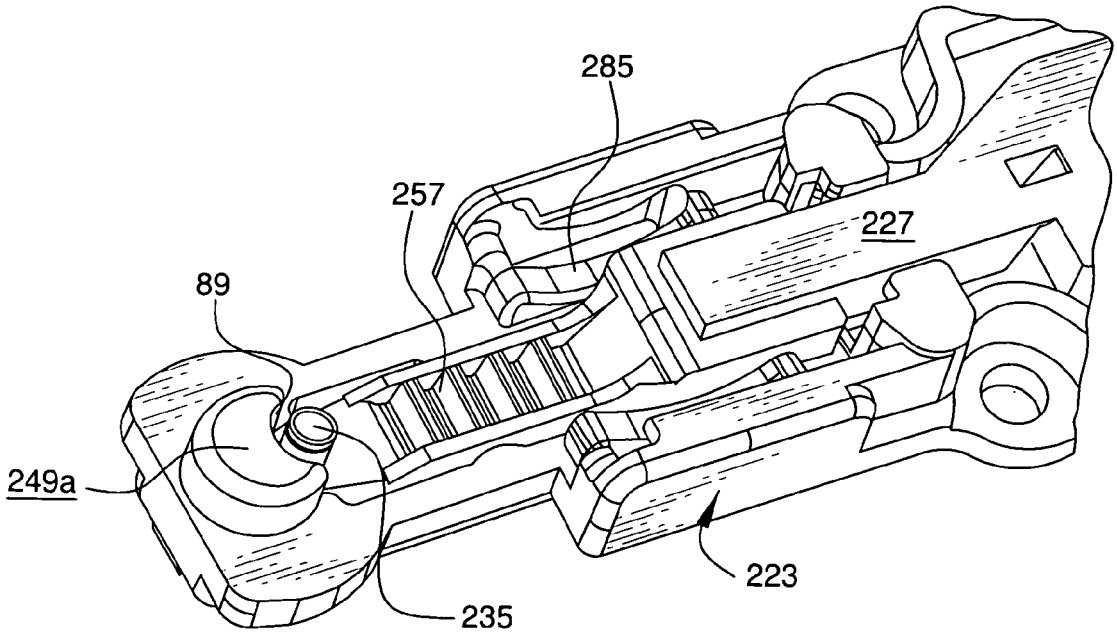
FIG. 26 is a partial perspective view of the housing with the slidable lock plate and damper assembly installed.

The paddle cam 283 end of the housing 223 incorpates has a pair of curved rocker-like surfaces 285, FIGS. 25, 26 which act as pivot shoulders for the paddle cam 283 when the paddle cam is installed into the housing 23 at that location. The pocket cam 239 pivot journal 249*a* now includes an arcuate cavity 287, FIG. 25. This arcuate cavity 287 provides a space for the cam follower pin 235 and thereby the sliding lock plate 231 to move closer to the handle 277 position and the rack teeth 257 projecting outwardly in the adjacent end of the lock plate 231 to be engaged by the paddle cam 283.

Figure 27A:
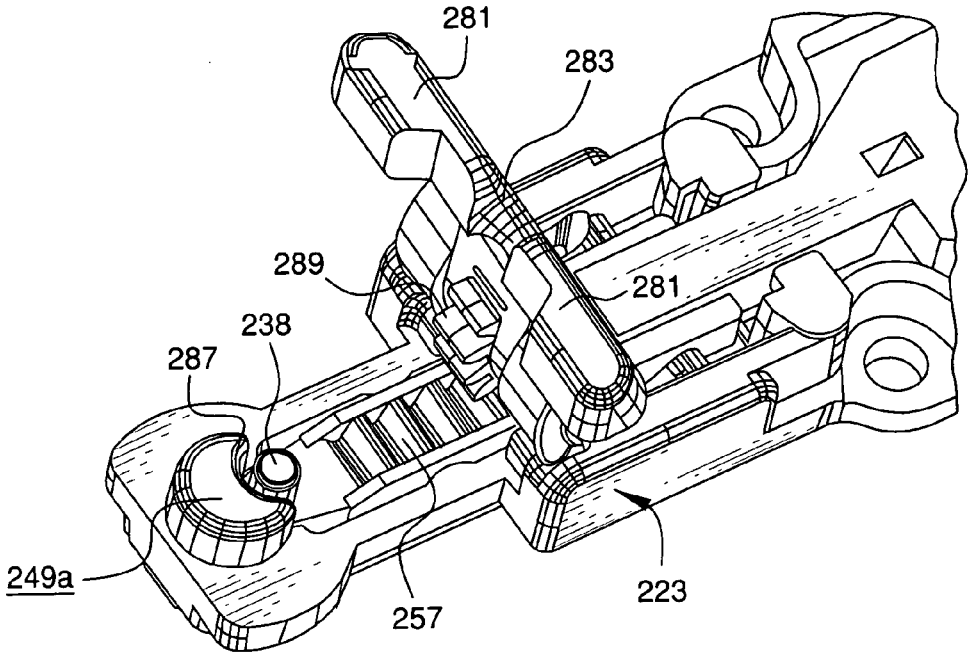
FIG. 27*a* is a partial perspective view of the assembly of FIG. 24*a* further with the paddle cam now installed.
Figure 27B:
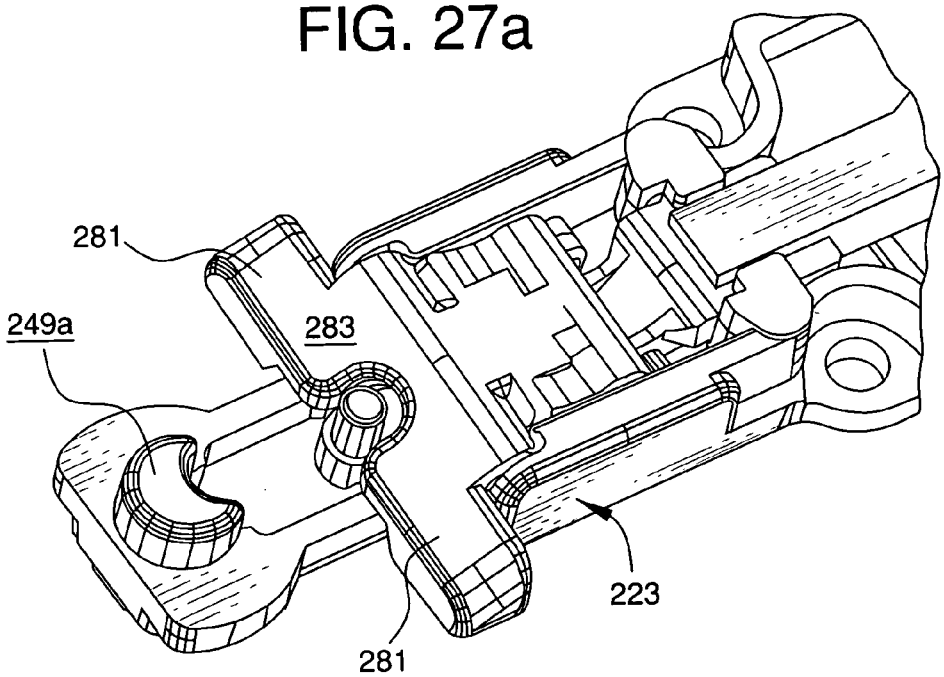
FIG. 27*b* is the partial perspective view of the partial assembly of FIG. 24*a* with the paddle cam pushed down into the housing.

The paddle cam 283 has its T-shaped handle projections 281 outboard of the housing, FIG. 27*a*. The underside of the paddle cam 283 has a curved section of gear teeth 289 which engage the rack teeth 257 on the face of the lock plate 231. The paddle cam 283 carries outboard projections shoulders 2103 on each side (shown in FIGS. 30*a*, 30*b*) discussed further below) which permit the paddle cam 83 to be snapped into receiving indentations 286 adjacent each rocker surface 285 in the housing 223. When snapped into position, the paddle cam 283 seats down into the housing 223, FIG. 27*b*.

Figure 28A:
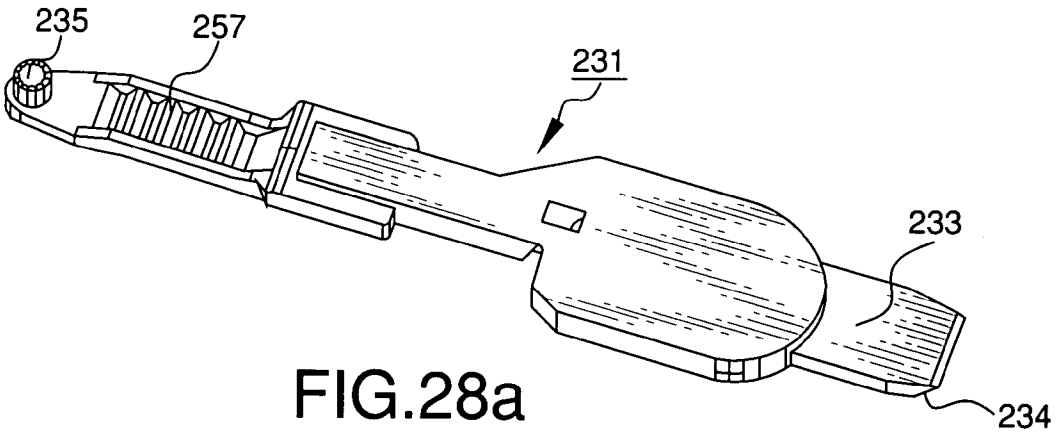
FIG. 28*a* is a perspective top view of the slidable lock plate for the latch assembly of FIG. 24*a;*
Figure 28B:
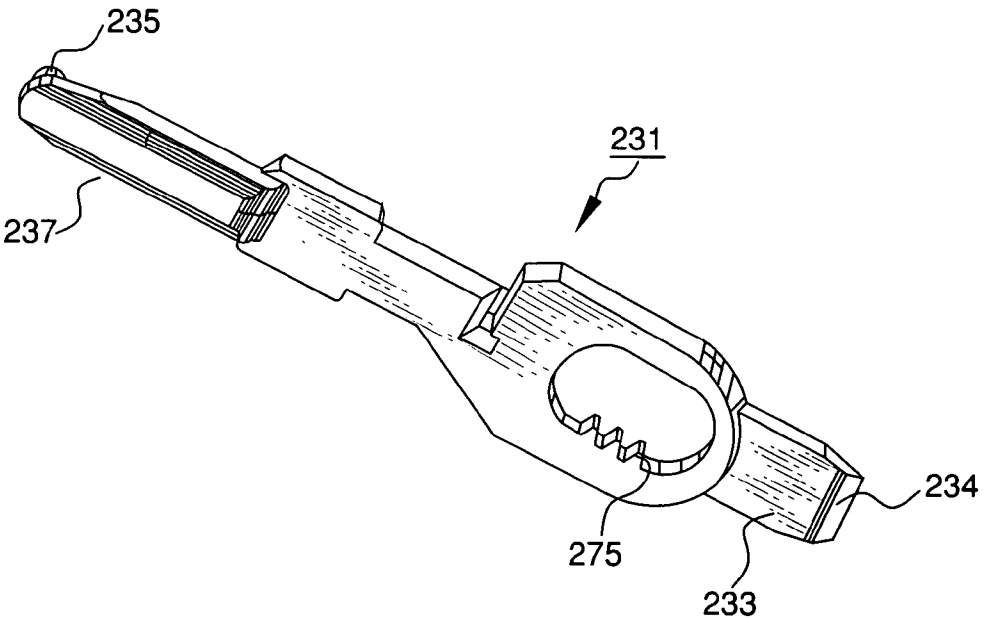
FIG. 28*b* is a perspective bottom view of the slidable lock plate of FIG. 28*a;*

A perspective view detail of the sliding lock plate 231 is shown in a top view, FIG. 28*a*, and a bottom view, FIG. 28*b*. The lock plate 231 is planar, with rectangular sections and with a flat rectangular blade 233 extending, longitudinally in the plane of the plate 231 and the track teeth 57 extending upwardly (outwardly) from the top face of the plate 231. The outer edge 234 of the blade 233 is tapered or beveled. The number of track teeth 57 will depend upon the adjustments necessary for various installations and the length of travel for the lock plate 231. Typically there are provided four (4) rack teeth 257 and four paddle cam teeth 289. As seen, there are provided only three lock plate cavity teeth 75, FIG. 28*b*.

Figure 29A:
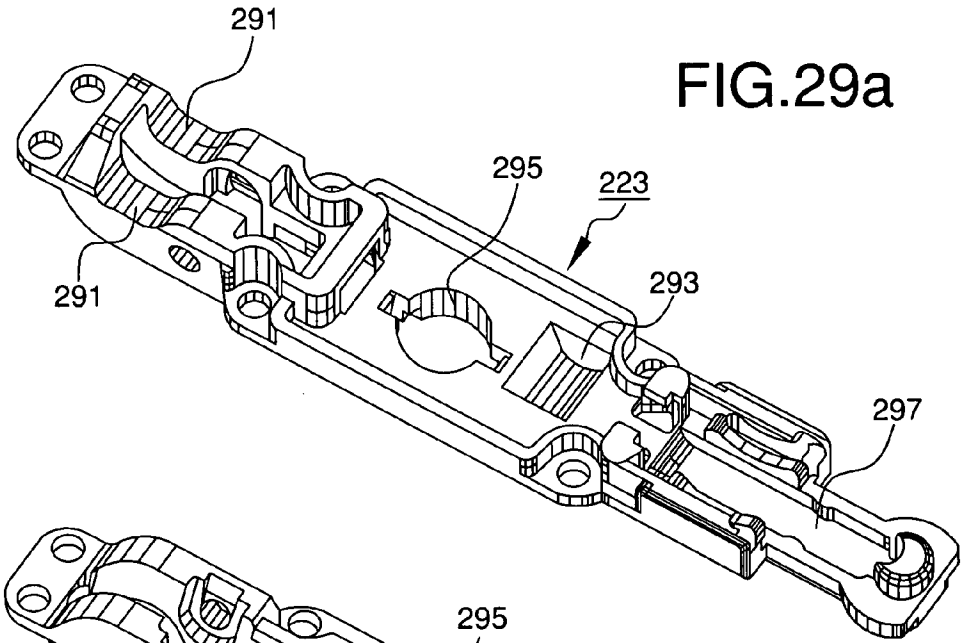
FIG. 29*a* is a perspective top view of the housing for the latch assembly of FIG. 24*a;*
Figure 29B:
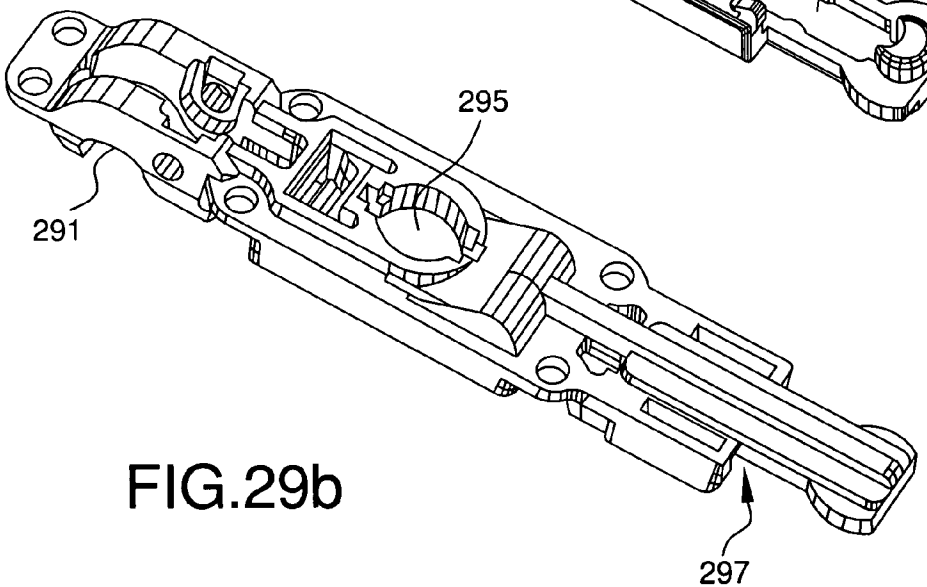
FIG. 29*b* is a perspective bottom view of the housing of FIG. 29*a;*

The cavities of the housing 223 are shown in detail in a top view FIG. 29*a* and a bottom view 29*b*, respectively. These include curved keeper clearance surfaces 291, the lock plate torsion spring cavity 293, the friction clutch cavity 295 and the lock plate track cavity 297. Each of these cavities 293, 295 and 297 are located adjacent the respective active member locations recited above.

Figure 30A:
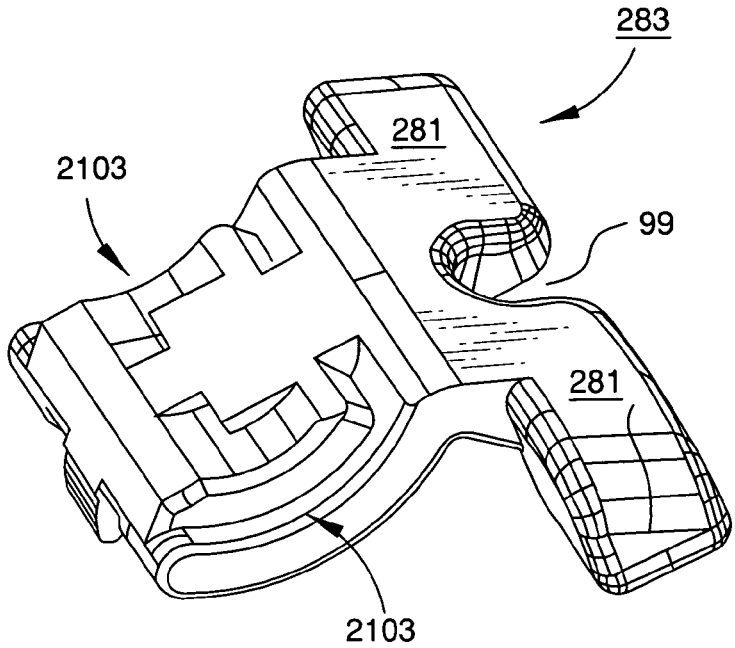
FIG. 30*a* is a perspective top view of the paddle cam used for the latch assembly of FIG. 24*a;*
Figure 30B:
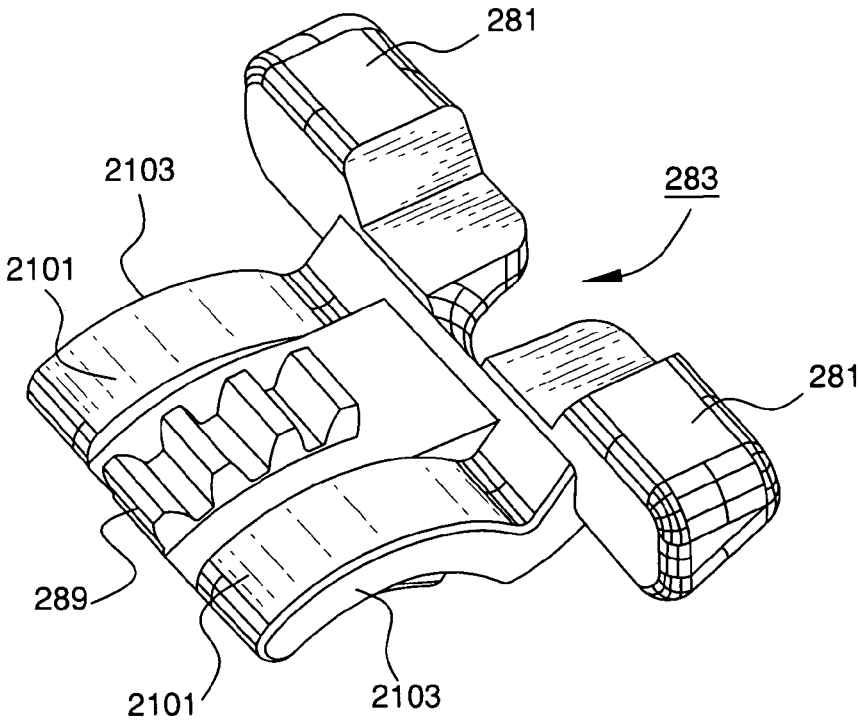
FIG. 30*b* is a perspective bottom view of the paddle cam of FIG. 30*a;*

The rocker shape of the paddle cam 283 is shown is a top view, FIG. 30*a*, and a bottom view FIG. 30*b*, respectively. The paddle cam 283 projections 281 form handle like wings, with a curved opening 299 there between. This opening 299 provides a clearance for the paddle cam 283 to fully seat about the cam follower pin 235 (FIGS. 24*a*, 27*b*) which pin 235 remains as a part of the housing 223 when the latch assembly 221 is reconfigured. Curved rocker surfaces 2101 on either side of the bottom of the paddle cam 283 have a curvature that mates the curvature of the rocker surfaces 285 of the housing 223. These curved surfaces 2101 mate with and rock on the curved rocker surfaces 285.

Figure 31A:
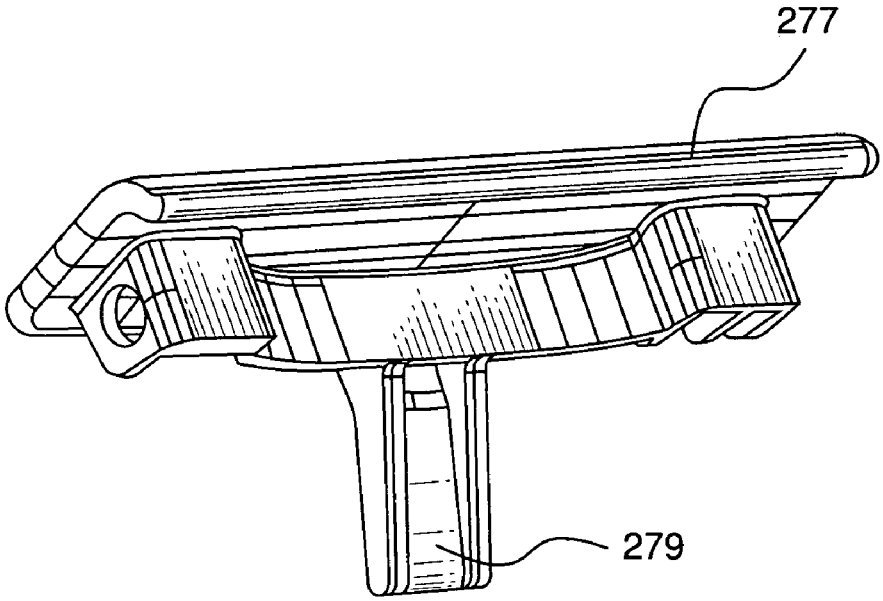
FIG. 31*a* is a front perspective view of the operator handle (paddle) used with the latch assembly of FIG. 24*a*.
Figure 31B:
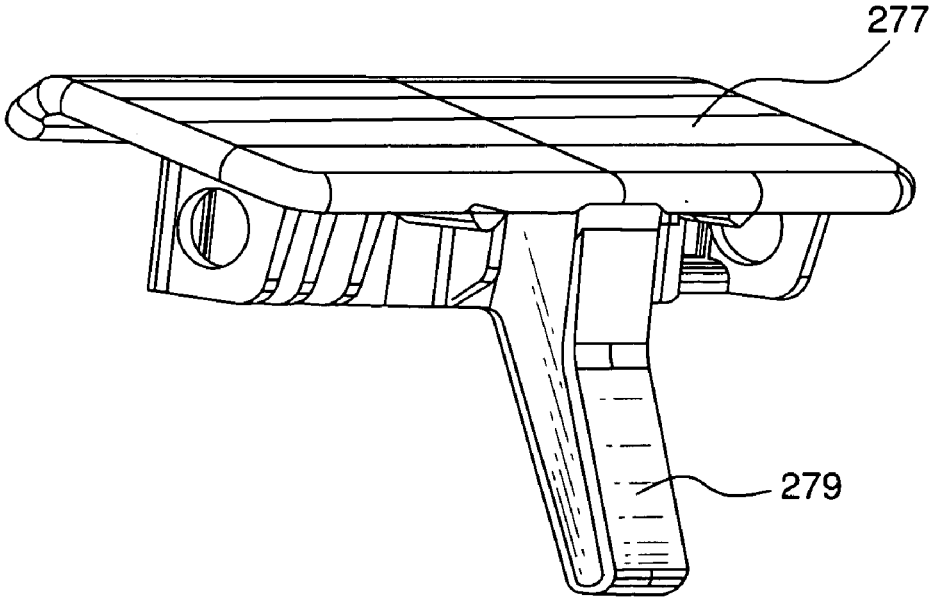
FIG. 31*b* is a rear perspective view of the operator handle of FIG. 31*a*.

The shovel shaped long arm 279 extending from the handle 277, FIGS. 31*a*, 31*b* is slightly curved or angled to engage one of the adjacent one of the projections 281 of the paddle cam 283. As the paddle cam 283 and its interaction with the sliding lock plate 231 face track teeth 257 is symmetrical reconfiguration between left-hand and right-hand operation by merely involves flipping the latch assembly 221 end for end to engage the alternate handle 277 location.

Regardless of installation, the handles (paddles) 125, 131, 247 and 277 each pivot about an axis that extends parallel to the longitudinal axis of the latch assembly. In so pivoting, each handle 125, 131, 247 and 277 causes its respective activation suface/member 126, 143, 245 and 279 to move in a plane transverse (perpendicular) to the longitudinal axis of the latch assembly.

Many changes can be made in the above-described invention without departing from the intent and scope thereof. It is therefore intended that the above description be read in the illustrative sense and not in the limiting sense. Substitutions and changes can be made while still being within the scope and intent of the invention as described and claimed.

What is claimed:

1. A latch assembly, comprising:

an elongate housing;

a pawl for engagement with a keeper and release therefrom, said pawl being mounted for movement at a location at one end of said housing;

a locking plate slidingly mounted in said housing, said locking plate being shaped at one end thereof for engagement with said pawl for locking the operation thereof;

a biasing return spring operating to encourage said locking plate into engagement with said pawl;

an activation mechanism for transferring movement of an operator handle to said sliding locking plate for unlocking said pawl;

wherein said activation mechanism includes a transversely projecting transfer member for transferring handle motion to said locking plate; and wherein said slidingly mounted locking plate has carried thereon a sliding motion damper being in operative connection thereto so as to regulate the velocity thereof.

2. The latch assembly of claim 1, wherein said transversely projecting transfer member includes a pinion gear with a radially extending cantilever arm, said cantilever arm being capable of being engaged by said handle and thereby rotating said pinion gear.

3. The latch assembly of claim 2, wherein said sliding locking plate includes at least one track of teeth along its outer edge, said track of teeth being engaged with said pinion gear to move said locking plate when said pinion gear is rotated.

4. The latch assembly of claim 3, wherein said locking plate includes a second track of teeth along it opposite outer edge, juxtaposed said first track of teeth, wherein said sliding locking plate is symmetrically shaped.

5. The latch assembly of claim 3, also including a dog-leg shaped arm at the non-pawl end of said sliding locking plate, said dog-leg shaped arm projecting outwardly from the end of said locking plate and in the plane thereof.

6. The latch assembly of claim 5, also including a further track of teeth along the edge of said dog-leg shaped arm and extending parallel to the longitudinal axis of said sliding locking plate.

7. The latch assembly of claim 6, wherein said housing carries a plurality of mounting bosses being used to mount said latch assembly and to mount components to said housing.

8. The latch assembly of claim 7, wherein said dog-leg shaped arm teeth face the opposite direction from said sliding locking plate edge teeth, whereby said pinion gear is mounted on a housing boss to engage said sliding locking plate edge teeth in one operational configuration and mounted on another housing boss to engage said dog-leg shaped arm teeth in another operational configuration.

9. The latch assembly of claim 8, wherein said latch assembly is flipped end-for-end for re-configuring between left and right hand operation.

10. The latch assembly of claim 9, wherein said sliding locking plate is spring biased into engagement to lock said pawl movement, and wherein said cantilever arm is engaged at said extreme end thereof by said handle to move said cantilever arm thereby to rotate said pinion gear.

11. The latch assembly of claim 9, wherein said sliding locking plate is spring biased into engagement to lock said pawl movement, and wherein said cantilever arm is engaged at a side thereof by a projection on said handle to rotate cantilever arm thereby to rotate said pinion gear.

12. A latch assembly, comprising:

an elongate housing;

a pawl for engagement with a keeper and release therefrom, said pawl being mounted for movement at a location at one end of said housing;

a locking plate slidingly mounted in said housing, said locking plate being shaped at one end thereof for engagement with said pawl for locking the operation thereof; and an activation mechanism for transferring movement of an operator handle to said sliding locking plate for unlocking said pawl;

wherein said activation mechanism includes a transversely projecting transfer member for transferring handle motion to said locking plate; and wherein said slidingly mounted locking plate carries a sliding motion damper being in operative connection thereto so as to regulate the velocity thereof;

wherein said transversely projecting transfer member includes a pocket cam member with a radially projecting finger, said projecting finger being capable of being engaged by said handle and thereby rotating said pocket cam.

13. The latch assembly of claim 12, wherein said pocket cam member includes a pivot lobe and cam lobe offset therefrom, and wherein said sliding locking plate carries a cam follower pin on the end thereof opposite said pawl, said cam follower pin engaging said cam lobe.

14. The latch assembly of claim 13 wherein said pocket cam member is symmetrically shaped and said cam lobe is oval.

15. A latch assembly, comprising:

an elongate housing;

a pawl for engagement with a keeper and release therefrom, said pawl being mounted for movement at a location at one end of said housing;

a locking plate slidingly mounted in said housing, said locking plate being shaped at one end thereof for engagement with said pawl for locking the operation thereof; and an activation mechanism for transferring movement of an operator handle to said sliding locking plate for unlocking said pawl;

wherein said activation mechanism includes a transversely projecting transfer member for transferring handle motion to said locking plate;

wherein said transversely projecting transfer member includes a pocket cam member with a radially projecting finger, said projecting finger being capable of being engaged by said handle and thereby rotating said pocket cam;

wherein said pocket cam member includes a pivot lobe and cam lobe offset therefrom, and wherein said sliding locking plate carries a cam follower pin on the end thereof opposite said pawl, said cam follower pin engaging said cam lobe;

wherein said pocket cam member is symmetrically shaped and said cam lobe is oval; and wherein said sliding locking plate carries a sliding motion damper and being in operative connection thereto so as to regulate the velocity thereof.

16. The latch assembly of claim 15, wherein said sliding locking plate is spring biased into locking contact with said pawl, said damper includes a gear operated friction damper, and wherein said sliding locking plate carries a track of teeth engaged by said friction damper gear.

17. The latch assembly of claim 1, wherein said transversely projecting transfer member includes a T-shaped paddle cam with outwardly projecting paddle arms, one of which being capable of being engaged by said handle and thereby rotating said paddle cam.

18. The latch assembly of claim 17, wherein said sliding locking plate includes a track of teeth at the end thereof opposite said pawl, said locking plate teeth being outwardly projecting from a face of said locking plate; and wherein said paddle cam includes a curved bottom surface carrying a series of gear-type teeth engaged with said locking arm teeth.

19. The latch assembly of claim 18, wherein said housing has a pair of rocker surfaces on either side thereof at the end opposite said pawl, and wherein said paddle cam has a pair of rocker surfaces shaped to ride on said housing rocker surfaces.

20. The latch assembly of claim 19 wherein said housing has an arctuate cavity in each inside wall adjacent said rocker surface, said arcuate cavities each receiving an outward projection shoulder formed on said paddle cam as the terminus of each said paddle cam rocker surface to hold said paddle cam into said housing; wherein said sliding locking plate is spring biased into locking contact with said pawl; and wherein when said paddle cam is rotated, said gear-type teeth engaged with said locking plate teeth withdraws said locking plate from contact with said pawl.

21. The latch assembly of claim 1, wherein said activation mechanism is directly connected between said operator handle and said sliding locking plate and in constant contact with each of them.

* * * * *

UNITED STATES PATENT AND TRADEMARK OFFICE

CERTIFICATE OF CORRECTION

PATENT NO. : 7,185,927 B2
APPLICATION NO. : 10/409480
DATED : March 6, 2007
INVENTOR(S) : Talukdar et al.

It is certified that error appears in the above-identified patent and that said Letters Patent is hereby corrected as shown below:

Title page, in the Abstract, line 2, replace “claw-typed” with --claw-type--;
Title page, in the Abstract, line 5, replace “form” with --from--;
Title page, in the Abstract, line 9, insert between “the” and “paddle/blade” --pocket cam, engages end teeth on the slide lock plate. A second pinion gear substituted for a--;
Title page, in the Abstract, line 11, replace “dog leg-shaped” with --dog-leg shaped--;
Column 1, line 10, replace “Govebox” with --Glovebox--;
Column 6, line 46, delete “126” after “surface”;
Column 6, line 50, replace “keeper hook 129” with --keeper 139 hook--;
Column 6, line 67, insert --(shown in Fig. 8d)-- after “cylinder mechanism 134”;
Column 7, line 30, replace “133” with --145--;
Column 7, line 41, replace “keyed” with --key--;
Column 7, line 43, replace “151” with --153--;
Column 7, line 46, delete “149a”;
Column 8, line 25, delete --135-- before “return spring”;
Column 8, line 33, replace “on” with --one--;
Column 9, line 35, replace “cam 39” with --cam 239--;
Column 9, line 41, replace “cam 235” with --cam 239--;
Column 9, line 47, replace “253” with --251--;
Column 9, line 55, replace “235” with --237--;
Column 9, line 62, replace “235” with --239--;
Column 10, line 8, replace “an” with --a--;
Column 10, line 58, replace “21” with --221--;
Column 11, line 1, replace “2727a” with --27a--;
Column 11, line 5, replace “57” with --257--;
Column 11, line 10, replace “23” with --223--;
Column 11, line 24, replace “83” with --283--;

UNITED STATES PATENT AND TRADEMARK OFFICE

CERTIFICATE OF CORRECTION

PATENT NO. : 7,185,927 B2
APPLICATION NO. : 10/409480
DATED : March 6, 2007
INVENTOR(S) : Talukdar et al.

It is certified that error appears in the above-identified patent and that said Letters Patent is hereby corrected as shown below:

Column 11, line 33, replace “57” with --257--;
Column 11, line 36, replace “57” with --257--;
Column 11, line 40, replace “75” with --275--.

Signed and Sealed this

Second Day of September, 2008

JON W. DUDAS
*Director of the United States Patent and Trademark Office*